US011133589B2

(12) United States Patent
Montgomery

(10) Patent No.: US 11,133,589 B2
(45) Date of Patent: Sep. 28, 2021

(54) ANTENNA

(71) Applicant: Airgain Incorporated, San Diego, CA (US)

(72) Inventor: Mark Thomas Montgomery, Melbourne Beach, FL (US)

(73) Assignee: Airgain, Inc., San Diego, CA (US)

( * ) Notice: Subject to any disclaimer, the term of this patent is extended or adjusted under 35 U.S.C. 154(b) by 25 days.

(21) Appl. No.: 16/729,233

(22) Filed: Dec. 27, 2019

(65) Prior Publication Data

US 2020/0220264 A1 Jul. 9, 2020

Related U.S. Application Data

(60) Provisional application No. 62/788,135, filed on Jan. 3, 2019.

(51) Int. Cl.

| | |
|---|---|
| ***H01Q 5/48*** | (2015.01) |
| ***H01Q 5/378*** | (2015.01) |
| ***H01Q 21/20*** | (2006.01) |

(52) U.S. Cl.
CPC ..... *H01Q 5/378* (2015.01); *H01Q 5/48* (2015.01); *H01Q 21/205* (2013.01)

(58) Field of Classification Search
CPC ..... H01Q 9/065; H01Q 5/378; H01Q 5/48; H01Q 21/065
See application file for complete search history.

(56) References Cited

U.S. PATENT DOCUMENTS

| | | | | |
|---|---|---|---|---|
| D418,142 | S | 12/1999 | Thill | |
| 6,087,990 | A | 7/2000 | Thill et al. | |
| 6,839,038 | B2 * | 1/2005 | Weinstein | H01Q 1/38 343/792.5 |
| 6,850,191 | B1 | 2/2005 | Thill et al. | |
| 7,061,437 | B2 | 6/2006 | Lin et al. | |
| 7,148,849 | B2 | 12/2006 | Lin | |
| 7,215,296 | B2 | 5/2007 | Abramov et al. | |
| D546,821 | S | 7/2007 | Oliver | |
| D549,696 | S | 8/2007 | Oshima et al. | |
| 7,333,067 | B2 | 2/2008 | Hung et al. | |
| 7,336,959 | B2 | 2/2008 | Khitrik et al. | |
| D573,589 | S | 7/2008 | Montgomery et al. | |
| 7,405,704 | B1 | 8/2008 | Lin et al. | |
| 7,477,195 | B2 | 1/2009 | Vance | |
| D592,195 | S | 5/2009 | Wu et al. | |
| 7,570,215 | B2 | 8/2009 | Abramov et al. | |

(Continued)

OTHER PUBLICATIONS

International Search Report for PCT Application PCT/US2019/068848, dated Apr. 9, 2020.

(Continued)

*Primary Examiner* — Hoang V Nguyen
(74) *Attorney, Agent, or Firm* — Clause Eight; Michael Catania

(57) ABSTRACT

A dual band horizontally polarized omnidirectional antenna is disclosed herein. The antenna comprises a dielectric, a top low band dipole arm, a narrow section of the arm, a capacitive extension of the arm, a top high band dipole arm, a narrow section of the high band arm, a first section of a transmission line, a second section of the transmission line, a feed pad, a coax center pin solder point, a bottom side array, a bottom side ground pad, and a hole for feed.

16 Claims, 22 Drawing Sheets

(56) References Cited

U.S. PATENT DOCUMENTS

| | | | |
|---|---|---|---|
| D599,334 | S | 9/2009 | Chiang |
| D606,053 | S | 12/2009 | Wu et al. |
| D607,442 | S | 1/2010 | Su et al. |
| D608,769 | S | 1/2010 | Bufe |
| D612,368 | S | 3/2010 | Yang et al. |
| 7,705,783 | B2 | 4/2010 | Rao et al. |
| 7,729,662 | B2 | 6/2010 | Abramov et al. |
| D621,819 | S | 8/2010 | Tsai et al. |
| 7,843,390 | B2 | 11/2010 | Liu |
| D633,483 | S | 3/2011 | Su et al. |
| D635,127 | S | 3/2011 | Tsai et al. |
| 7,907,971 | B2 | 3/2011 | Salo et al. |
| D635,560 | S | 4/2011 | Tsai et al. |
| D635,963 | S | 4/2011 | Podduturi |
| D635,964 | S | 4/2011 | Podduturi |
| D635,965 | S | 4/2011 | Mi et al. |
| D636,382 | S | 4/2011 | Podduturi |
| 7,965,242 | B2 | 6/2011 | Abramov et al. |
| D649,962 | S | 12/2011 | Tseng et al. |
| D651,198 | S | 12/2011 | Mi et al. |
| D654,059 | S | 2/2012 | Mi et al. |
| D654,060 | S | 2/2012 | Ko et al. |
| D658,639 | S | 5/2012 | Huang et al. |
| D659,129 | S | 5/2012 | Mi et al. |
| D659,685 | S | 5/2012 | Huang et al. |
| D659,688 | S | 5/2012 | Huang et al. |
| 8,175,036 | B2 | 5/2012 | Visuri et al. |
| 8,184,601 | B2 | 5/2012 | Abramov et al. |
| D662,916 | S | 7/2012 | Huang et al. |
| 8,248,970 | B2 | 8/2012 | Abramov et al. |
| D671,097 | S | 11/2012 | Mi et al. |
| 8,310,402 | B2 | 11/2012 | Yang |
| D676,429 | S | 2/2013 | Gosalia et al. |
| D678,255 | S | 3/2013 | Ko et al. |
| 8,423,084 | B2 | 4/2013 | Abramov et al. |
| D684,565 | S | 6/2013 | Wei |
| D685,352 | S | 7/2013 | Wei |
| D685,772 | S | 7/2013 | Zheng et al. |
| D686,600 | S | 7/2013 | Yang |
| D689,474 | S | 9/2013 | Yang et al. |
| D692,870 | S | 11/2013 | He |
| D694,738 | S | 12/2013 | Yang |
| D695,279 | S | 12/2013 | Yang et al. |
| D695,280 | S | 12/2013 | Yang et al. |
| 8,654,030 | B1 | 2/2014 | Mercer |
| 8,669,903 | B2 | 3/2014 | Thill et al. |
| D703,195 | S | 4/2014 | Zheng |
| D703,196 | S | 4/2014 | Zheng |
| D706,247 | S | 6/2014 | Zheng et al. |
| D706,750 | S | 6/2014 | Bringuir |
| D706,751 | S | 6/2014 | Chang et al. |
| D708,602 | S | 7/2014 | Gosalia et al. |
| D709,053 | S | 7/2014 | Chang et al. |
| D710,832 | S | 8/2014 | Yang |
| D710,833 | S | 8/2014 | Zheng et al. |
| 8,836,606 | B2 | 9/2014 | Kish et al. |
| 8,854,265 | B1 | 10/2014 | Yang et al. |
| D716,775 | S | 11/2014 | Bidermann |
| 9,407,012 | B2 | 8/2016 | Shtrom et al. |
| 9,432,070 | B2 | 8/2016 | Mercer |
| 9,912,043 | B1 | 3/2018 | Yang |
| D818,460 | S | 5/2018 | Montgomery |
| D823,285 | S | 7/2018 | Montgomery |
| D832,241 | S | 10/2018 | He et al. |
| 10,109,918 | B2 | 10/2018 | Thill |
| 10,164,324 | B1 | 12/2018 | He et al. |
| D842,280 | S | 3/2019 | Montgomery |
| 10,305,182 | B1 | 5/2019 | Iellici |
| D857,671 | S | 8/2019 | Montgomery et al. |
| D859,371 | S | 9/2019 | Montgomery |
| D868,757 | S | 12/2019 | He et al. |
| 10,511,086 | B1 | 12/2019 | Thill |
| 2002/0003499 | A1 | 1/2002 | Kouam et al. |
| 2004/0222936 | A1 | 11/2004 | Hung et al. |
| 2005/0073462 | A1 | 4/2005 | Lin et al. |
| 2005/0073465 | A1* | 4/2005 | Olson ..... H01Q 5/42 343/795 |
| 2005/0190108 | A1 | 9/2005 | Lin et al. |
| 2006/0208900 | A1 | 9/2006 | Tavassoli Hozouri |
| 2007/0030203 | A1 | 2/2007 | Tsai et al. |
| 2008/0150829 | A1 | 6/2008 | Lin et al. |
| 2009/0002244 | A1 | 1/2009 | Woo |
| 2009/0058739 | A1 | 3/2009 | Konishi |
| 2009/0135072 | A1 | 5/2009 | Ke et al. |
| 2009/0262028 | A1 | 10/2009 | Murnbru et al. |
| 2010/0188297 | A1 | 7/2010 | Chen et al. |
| 2010/0302126 | A1 | 12/2010 | Shtrom et al. |
| 2010/0309067 | A1 | 12/2010 | Tsou et al. |
| 2011/0006950 | A1 | 1/2011 | Park et al. |
| 2011/0221648 | A1* | 9/2011 | Lee ..... H01Q 9/285 343/826 |
| 2012/0038514 | A1 | 2/2012 | Bang |
| 2012/0229348 | A1 | 9/2012 | Chiang |
| 2012/0242546 | A1 | 9/2012 | Hu et al. |
| 2014/0313093 | A1* | 10/2014 | Smith ..... H01Q 21/26 343/795 |
| 2016/0294063 | A1* | 10/2016 | McGough ..... H01Q 5/371 |
| 2016/0322709 | A1* | 11/2016 | Tao ..... H01Q 9/065 |
| 2017/0054204 | A1 | 2/2017 | Changalvala et al. |

OTHER PUBLICATIONS

Written Opinion for PCT Application PCT/US2019/068848, dated Apr. 6, 2020.

* cited by examiner

ANTENNA

CROSS REFERENCE TO RELATED APPLICATION

The Present Application claims priority to U.S. Provisional Patent Application No. 62/788,135, filed on Jan. 3, 2019, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

This invention relates to WiFi multi-antenna devices.

Description of the Related Art

There is a need to cover two bands, one low, such as 2.4 to 2.9 GigaHertz (GHz) and one high, such as 5.15 to 5.85 GHZ, both with omni horizontally polarization. The prior art has provided single band solutions.

Thus, there is a need for a better antenna.

BRIEF SUMMARY OF THE INVENTION

One aspect of the present invention is dual band horizontally polarized omnidirectional antenna.

Another aspect of the present invention is a dual band horizontally polarized omnidirectional antenna comprising a plurality of dipoles, a dielectric, a feed pad, a cox center pin solder point, a bottom side ground pad and a hole for feed. Each of dipole of the plurality of dipoles comprising a feed side low band dipole arm, a narrow section of the arm, a capacitive extension of the arm, a feed side high band dipole arm, a narrow section of the high band arm, a ground side low band dipole arm, a narrow section of the arm, a capacitive extension of the arm, a ground side high band dipole arm, a narrow section of the high band arm, a first section of a transmission line and a second section of the transmission line.

Another aspect of the present invention is a dual band horizontally polarized omnidirectional antenna. The antenna comprises a dielectric, a top low band dipole arm, a narrow section of the arm, a capacitive extension of the arm, a top high band dipole arm, a narrow section of the high band arm, a first section of a transmission line, a second section of the transmission line, a feed pad, a coax center pin solder point, a bottom side array, a bottom side ground pad, and a hole for feed.

Yet another aspect of the present invention is a dual band horizontally polarized omnidirectional. The antenna comprises a dielectric structure array, a top low band dipole arm, a narrow section of the arm, a capacitive extension of the arm, a top high band dipole arm, a narrow section of the high band arm, and a transmission line.

Yet another aspect of the present invention is a dual band horizontally polarized omnidirectional antenna. The antenna comprises a dielectric structure array, a feed pad, a first member, a second member and a third member. The first member comprises a transmission line extending from the feed pad, a top high band dipole, a capacitive extension, a top low band dipole arm and a narrow section between the capacitive extension and the top low band dipole arm. The second member comprises a transmission line extending from the feed pad, a top high band dipole, a capacitive extension, a top low band dipole arm and a narrow section between the capacitive extension and the top low band dipole arm. The third member comprising a transmission line extending from the feed pad, a top high band dipole, a capacitive extension, a top low band dipole arm and a narrow section between the capacitive extension and the top low band dipole arm.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
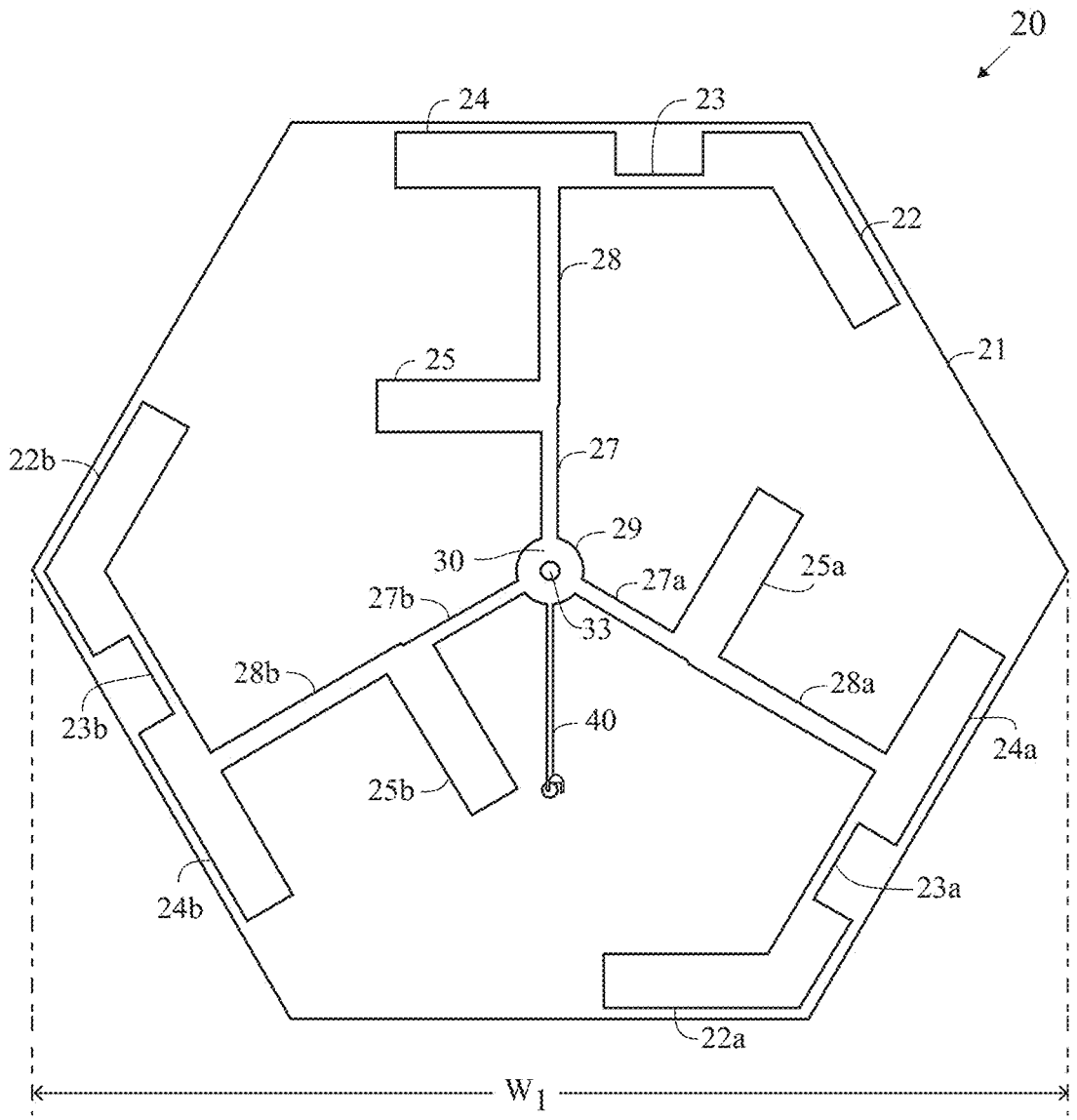
FIG. 1 is a bottom plan view of a dual band horizontally polarized omnidirectional antenna.
Figure 2:
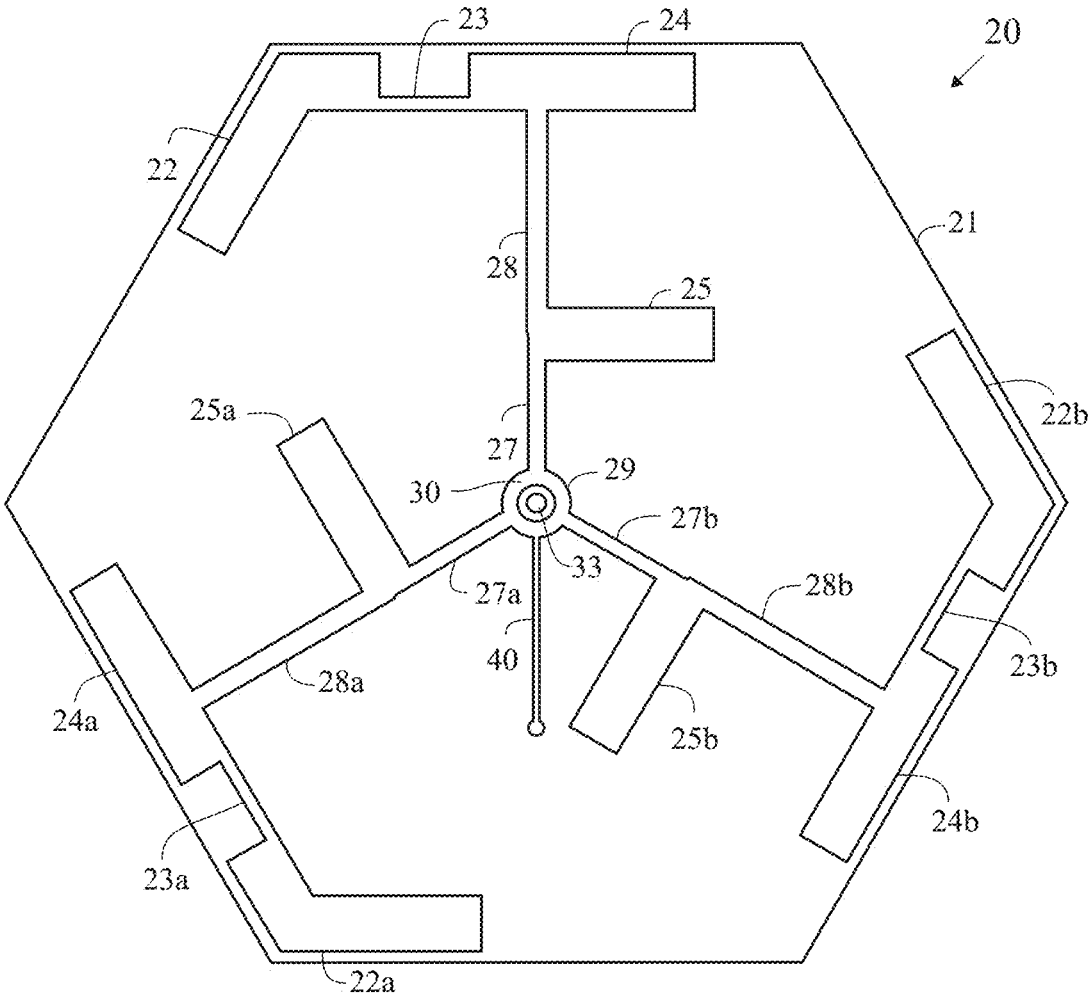
FIG. 2 is a top plan view of a dual band horizontally polarized omnidirectional antenna.
Figure 3:
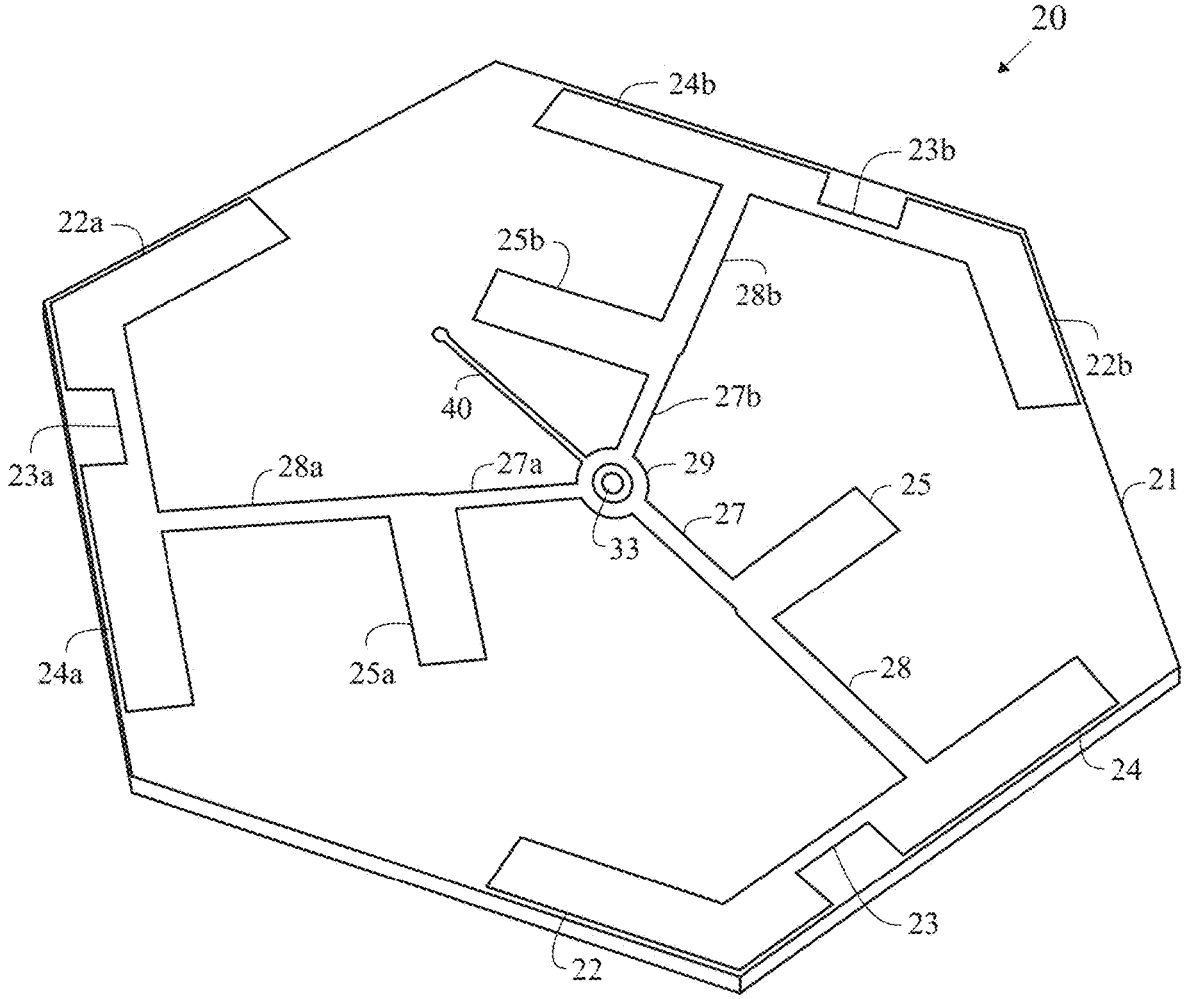
FIG. 3 is a top perspective view of a dual band horizontally polarized omnidirectional antenna.

As shown in FIGS. 1, 2 and 3, a preferred embodiment of a dual band horizontally polarized omnidirectional antenna 20 comprises a dielectric 21, a top low band dipole arm 22, 22*a* and 22*b*, a narrow section 23, 23*a* and 23*b* of the arm, a capacitive extension 24, 24*a* and 24*b* of the arm, a top high band dipole arm 25, 25*a* and 25*b*, a transmission line first section 27, 27*a* and 27*b*, a transmission line second section 28, 28*a* and 28*b*, a feed pad 29, a coax center pin solder point 30, a bottom side array, a bottom side ground pad, a hole 33 for feed, and an inductive connection between feed and ground 40.

For WiFi multi-antenna devices, the present invention covers both 2.4 GHz and 5 GHz bands, omnidirectional like a vertical dipole but with polarization that is horizontal. Design for production using printed circuit board. Cover two bands, one low as in 2.4 to 2.49 GHz (2G band), one high as in 5.15 to 5.85 GHz (5G band), both with omni horizontal polarization.

Figure 8:
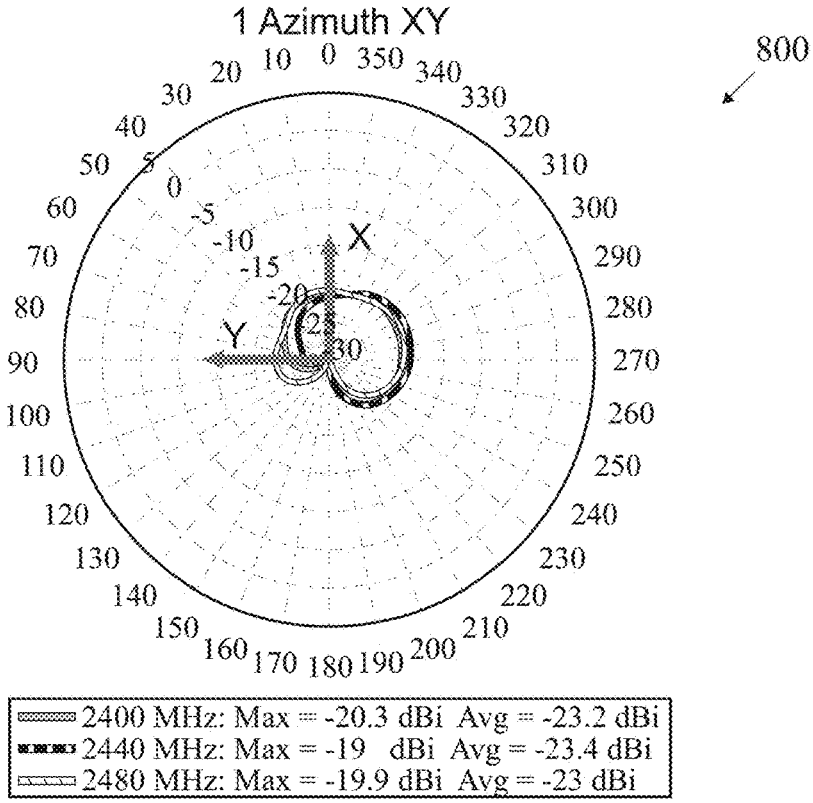
FIG. 8 is a graph of vertically polarized azimuth gain (dBi) for a 2G band.
Figure 9:
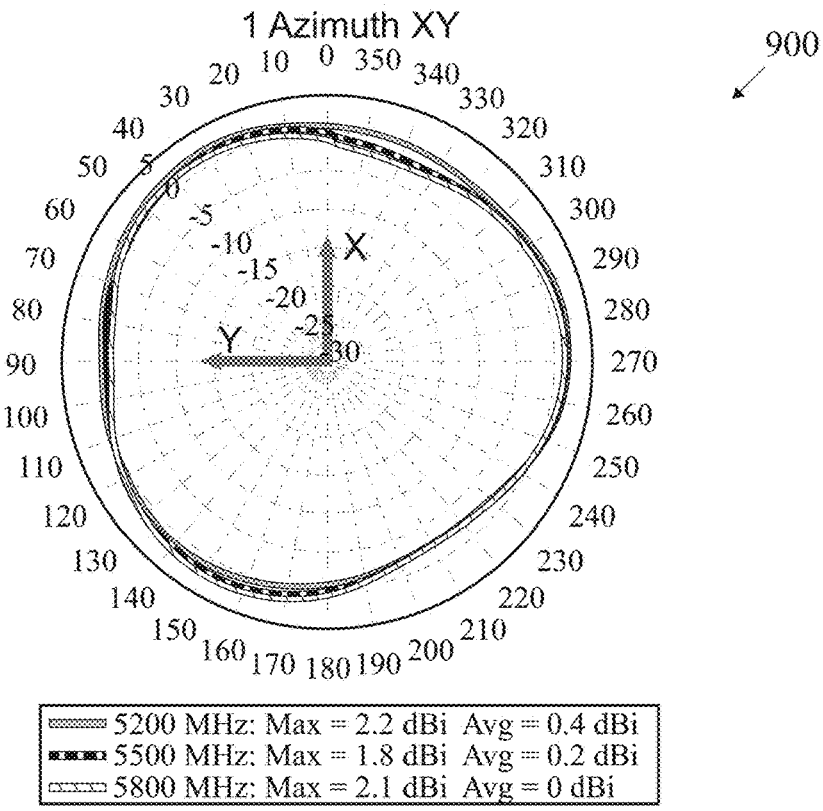
FIG. 9 is a graph of Azimuth XY for a total gain 5G Band.
Figure 10:
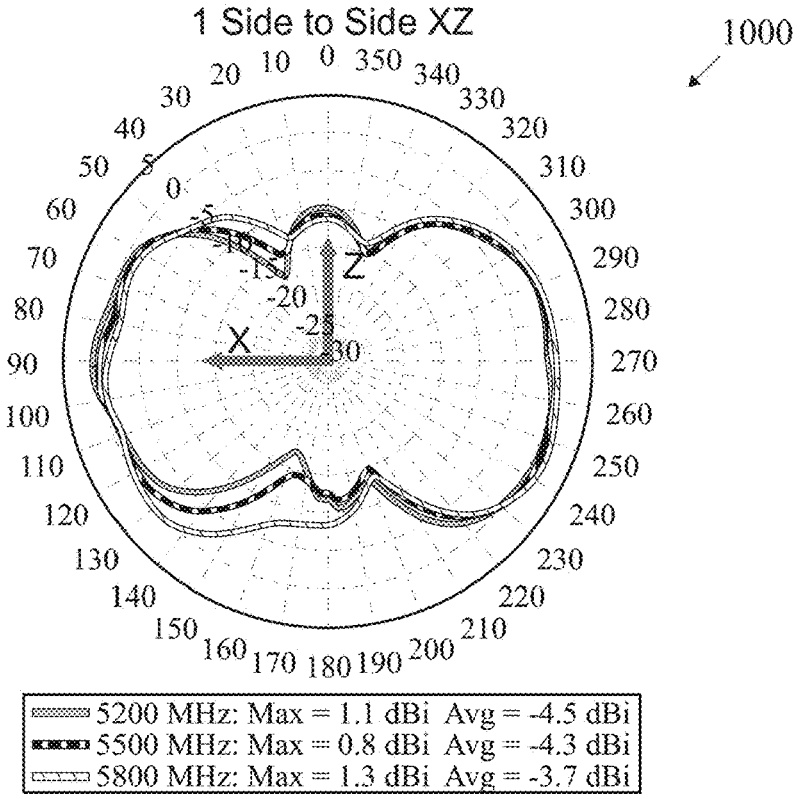
FIG. 10 is a graph of side to side XZ for a total gain 5G Band.
Figure 11:
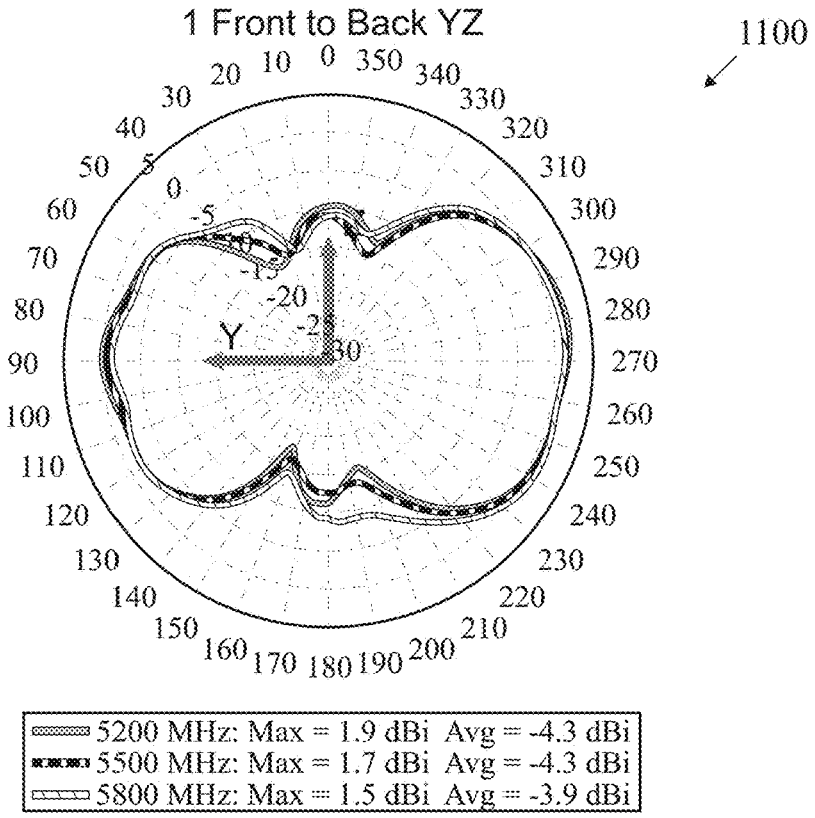
FIG. 11 is a graph of front to back YZ fora total gain 5G Band.
Figure 12:
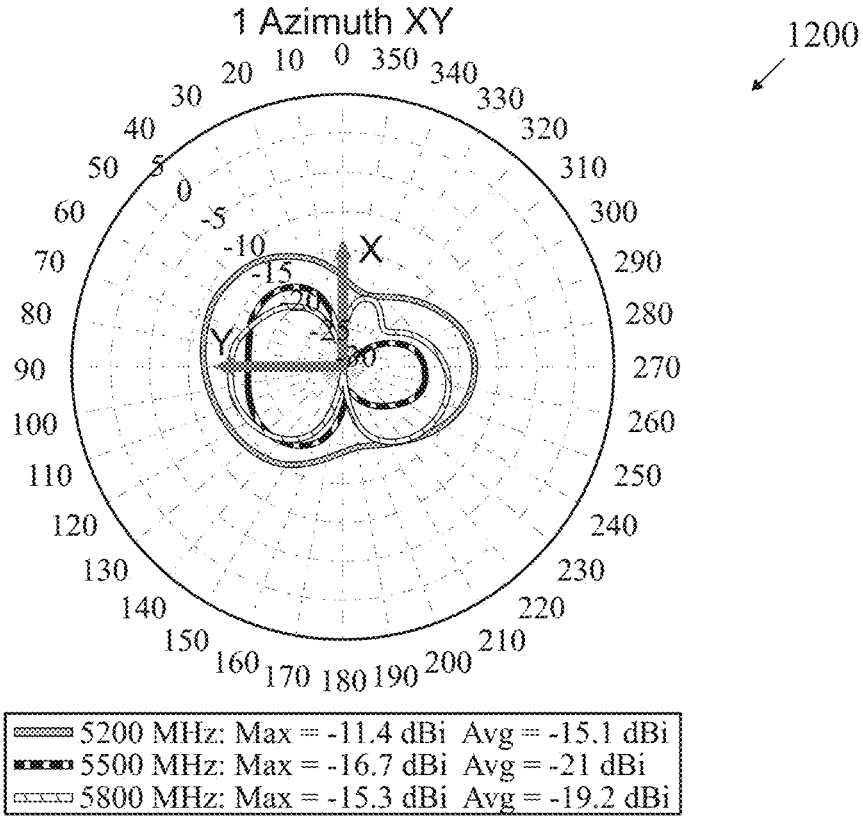
FIG. 12 is a graph of vertically polarized azimuth gain (dBi) for a 5G band.

The embodiment of FIGS. 1, 2 and 3, produces omnidirectional radiation patterns in both the 2G band (FIGS. 5, 6 and 7) and 5G band (FIGS. 9, 10 and 11). The gain is primarily horizontally polarized as evidenced by the lack of vertically polarized component of gain (FIGS. 8 and 12).

Larger dipoles in circular array for lower frequency band. Smaller dipoles also in circular array for higher frequency band fed from same network.

Using dual band dipoles as element of array has some deficiencies including array separation is not optimal for both bands simultaneously and patterns are less uniform, also impedance match is not broad band.

The high band dipole elements are placed at closer array spacing and flip polarity to increase independence from the lower band elements. The addition of capacitive overlap lowers the band dipole elements.

The present invention is used in WiFi wireless access points and routers.

Figure 13:
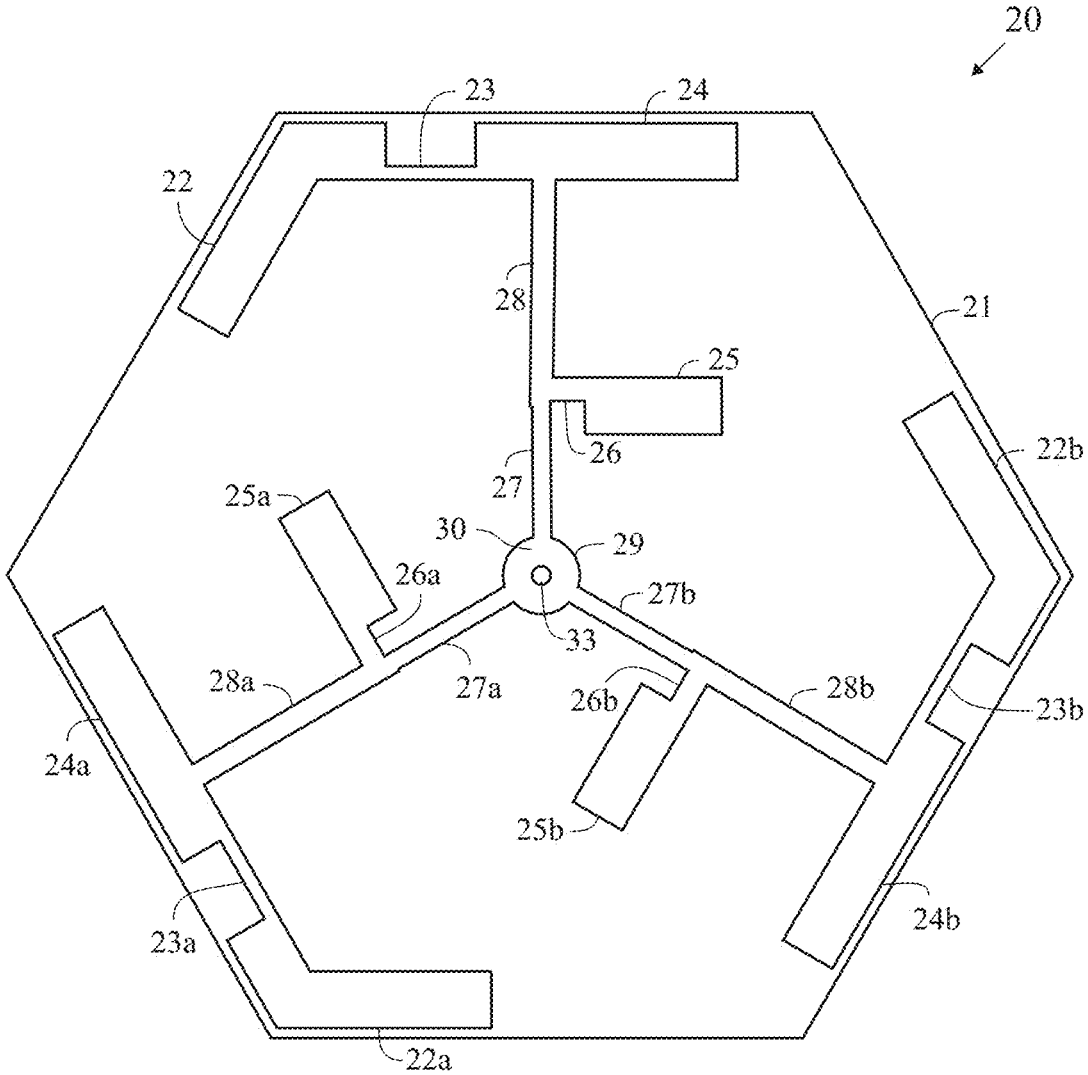
FIG. 13 is a bottom plan view of an alternative embodiment of a dual band horizontally polarized omnidirectional antenna.
Figure 14:
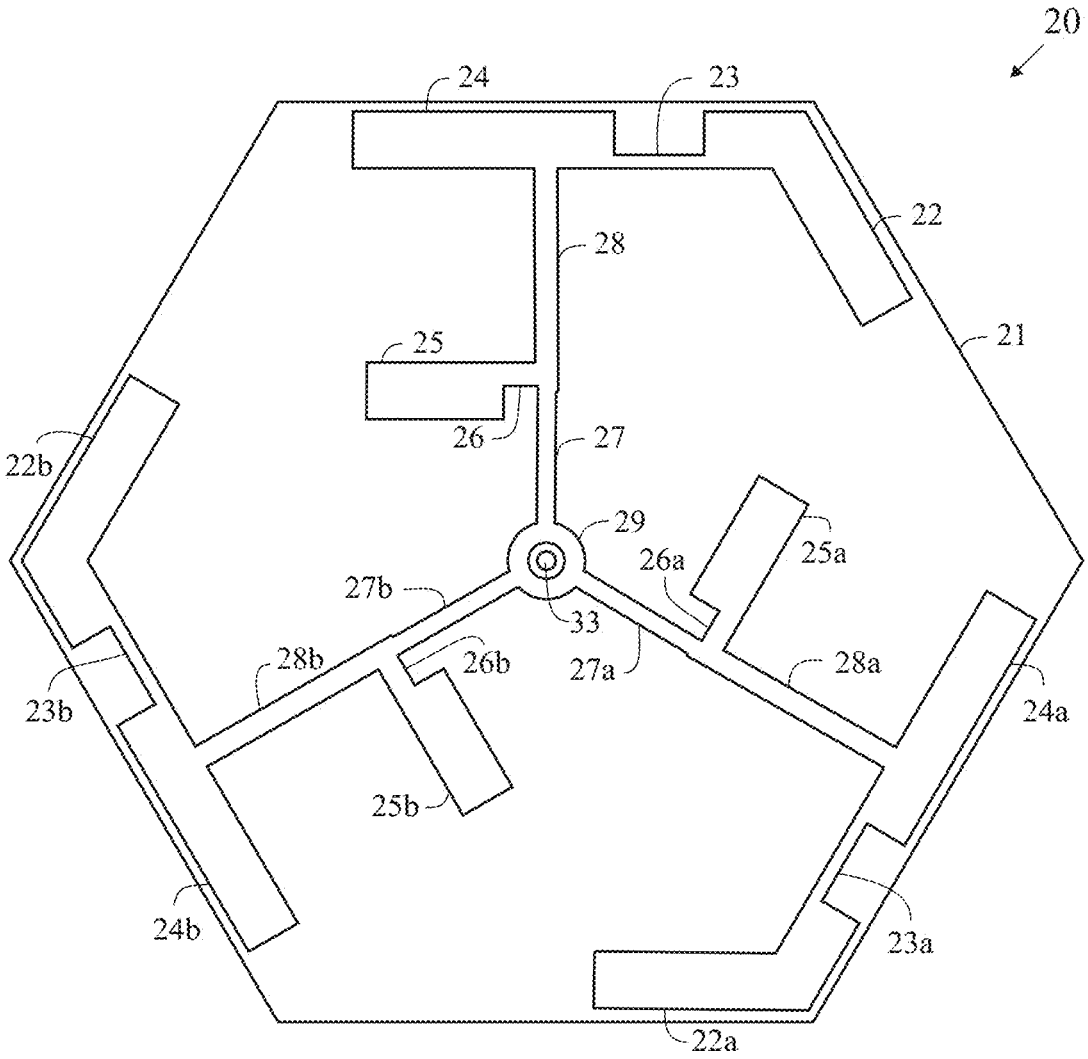
FIG. 14 is a top plan view of an alternative embodiment of a dual band horizontally polarized omnidirectional antenna.

As shown in FIGS. 13 and 14, an alternative embodiment of a dual band horizontally polarized omnidirectional antenna 20 comprises a dielectric 21, a top low band dipole arm 22, 22*a*, and 22*b*, a narrow section 23, 23*a* and 23*b* of the arm, a capacitive extension 24, 24*a* and 24*b* of the arm, a top high band dipole arm 25, 25*a* and 25*b*, a narrow section 26, 26*a* and 26*b* of the high band arm, a first section 27, 27*a* and 27*b* of a transmission line, a second section 28, 28*a* and 28*b* of the transmission line, a feed pad 29, a coax center pin solder point 30, a bottom side array, a bottom side ground pad, and a hole 33 for feed.

Figure 15:
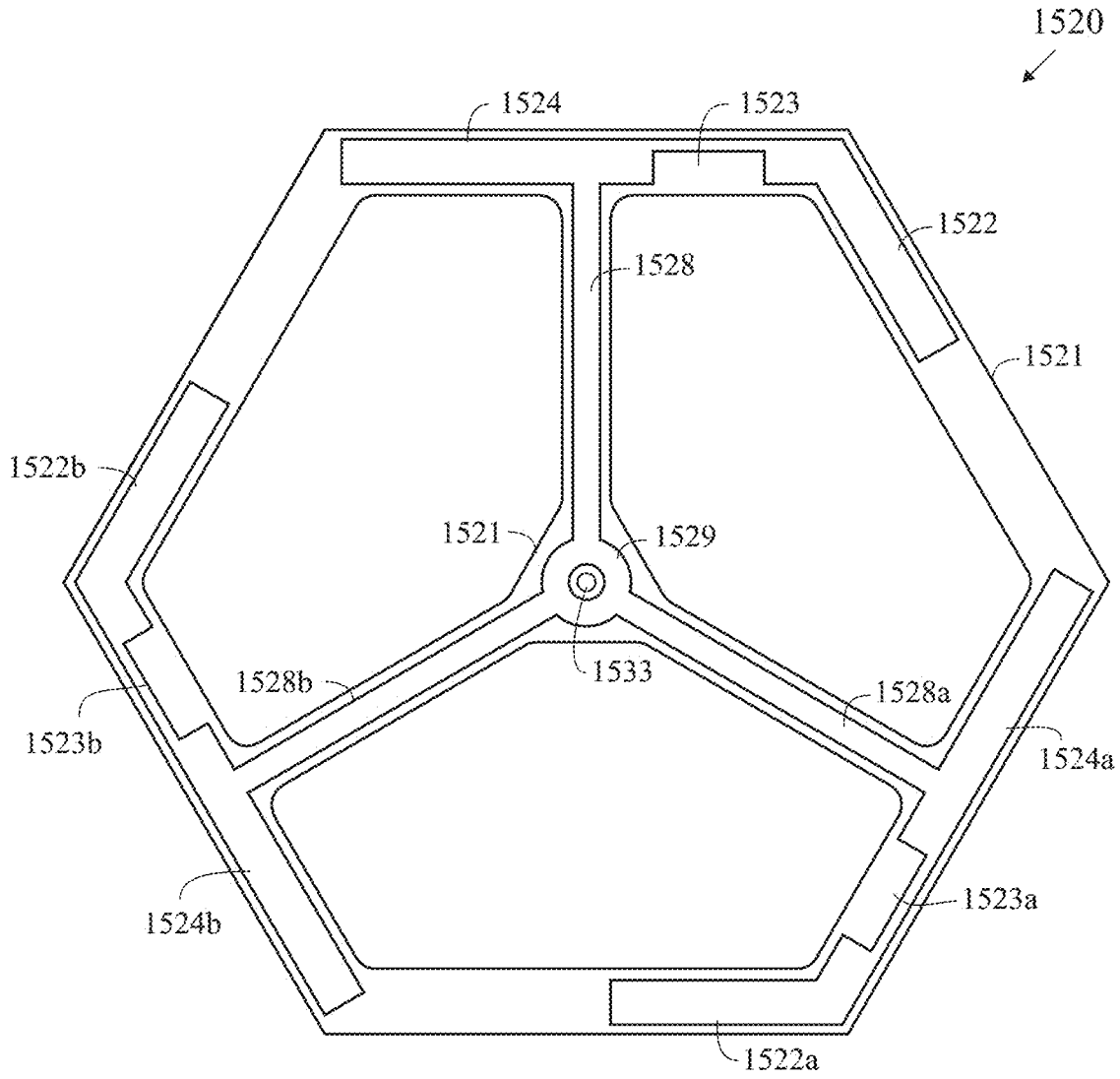
FIG. 15 is a top plan view of an alternative embodiment of a dual band horizontally polarized omnidirectional antenna.

As shown in FIG. 15, An alternative embodiment of a dual band horizontally polarized omnidirectional antenna 1520 comprises a dielectric 1521, a top low band dipole arm 1522, 1522*a*, and 1522*b*, a narrow section 1523, 1523*a* and 1523*b* of the arm, a capacitive extension 1524, 1524*a* and 1524*b* of the arm, a transmission line 1528, 1528*a* and 1528*b*, a feed pad 1529, a bottom side array, a bottom side ground pad, and a hole 1533 for feed.

Figure 16:
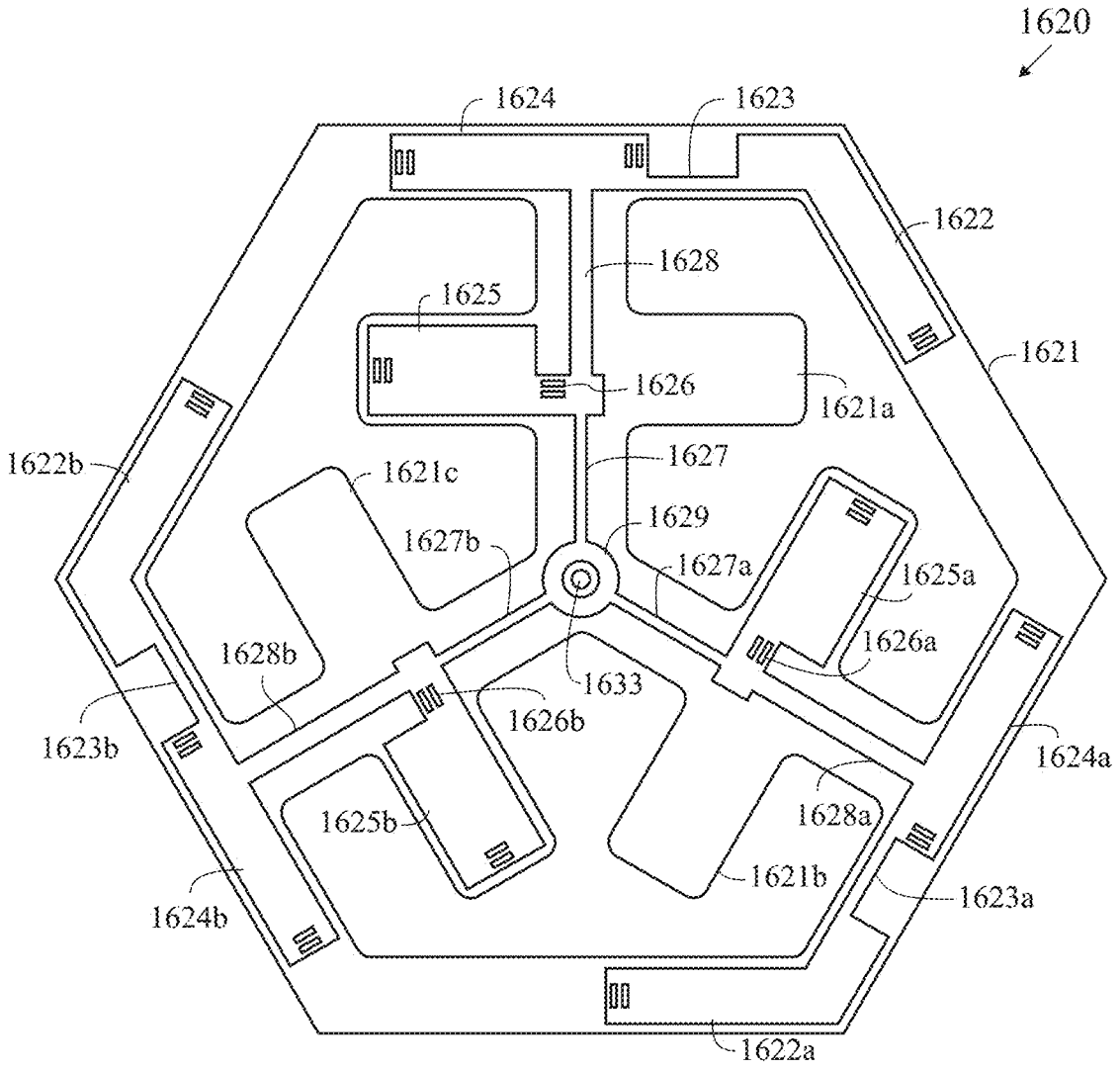
FIG. 16 is a top plan view of an alternative embodiment of a dual band horizontally polarized omnidirectional antenna.

As shown in FIG. 16, an alternative embodiment of a dual band horizontally polarized omnidirectional antenna 1620 comprises a dielectric 1621, a top low band dipole arm 1622, 1622*a*, and 1622*b*, a narrow section 1623, 1623*a* and 1623*b* of the arm, a capacitive extension 1624, 1624*a* and 1624*b* of the arm, a top high band dipole arm 1625, 1625*a* and 1625*b*, a narrow section 1626, 1626*a* and 1626*b* of the high band arm, a first section 1627, 1627*a* and 1627*b* of a transmission line, a second section 1628, 1628*a* and 1628*b* of the transmission line, a feed pad 1629, a coax center pin solder point 1630, dielectric extensions 1621*a*, 1621*b* and 1621*c*, a bottom side array, a bottom side ground pad, and a hole 1633 for feed.

Figure 17:
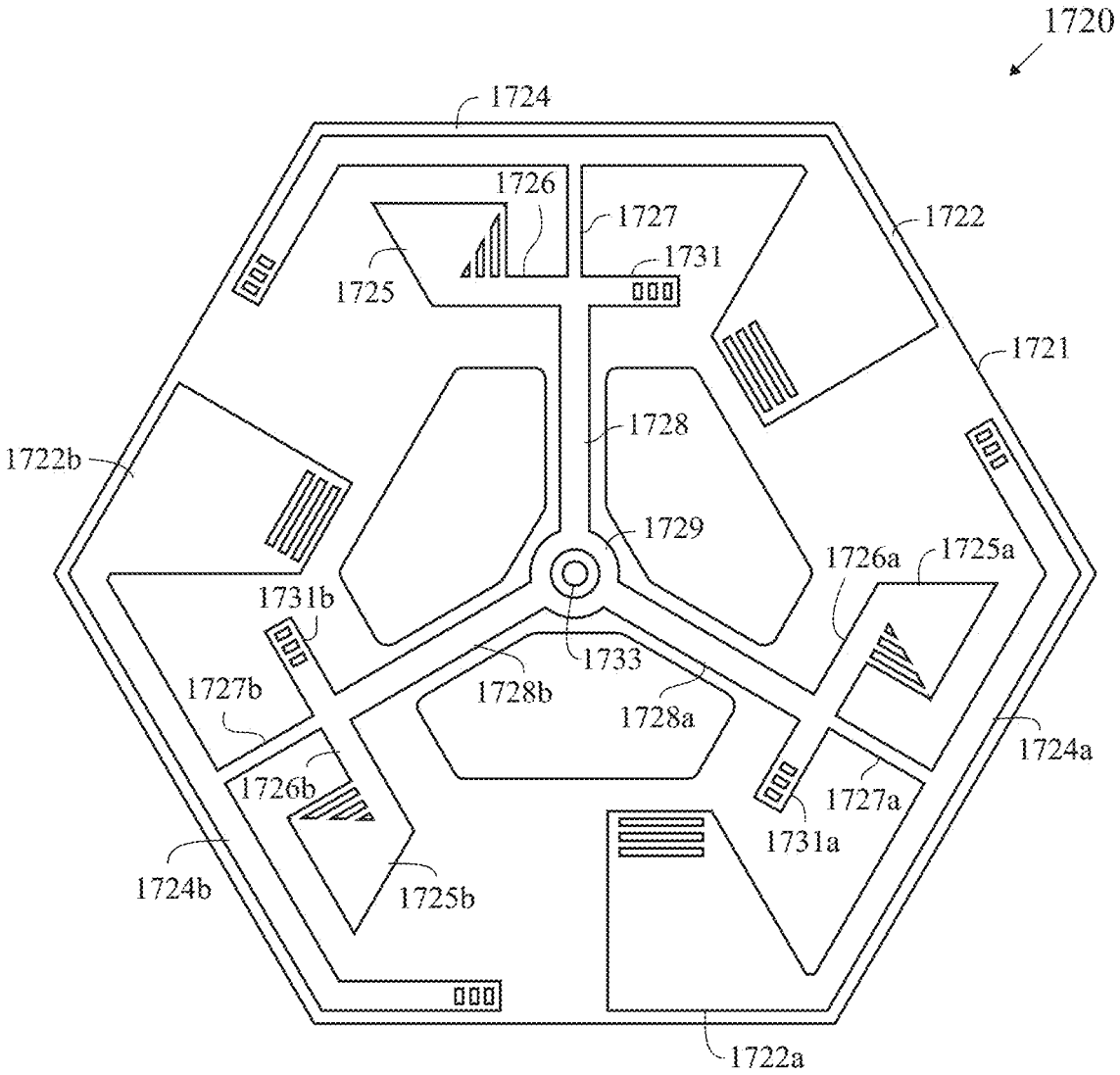
FIG. 17 is a top plan view of an alternative embodiment of a dual band horizontally polarized omnidirectional antenna.

As shown in FIG. 17, an alternative embodiment of a dual band horizontally polarized omnidirectional antenna 1720 comprises a dielectric 1721, a top low band dipole arm 1722, 1722*a*, and 1722*b*, a narrow section 1723, 1723*a* and 1723*b* of the arm, a capacitive extension 1724, 1724*a* and 1724*b* of the arm, a top high band dipole arm 1725, 1725*a* and 1725*b*, a narrow section 1726, 1726*a* and 1626*b* of the high band arm, a capacitive extension 1731, 1731*a* and 1731*b* of the arm, a first section 1727, 1727*a* and 1727*b* of a transmission line, a second section 1728, 1728*a* and 1728*b* of the transmission line, a feed pad 1729, a bottom side array, a bottom side ground pad, and a hole 1733 for feed.

Figure 18:
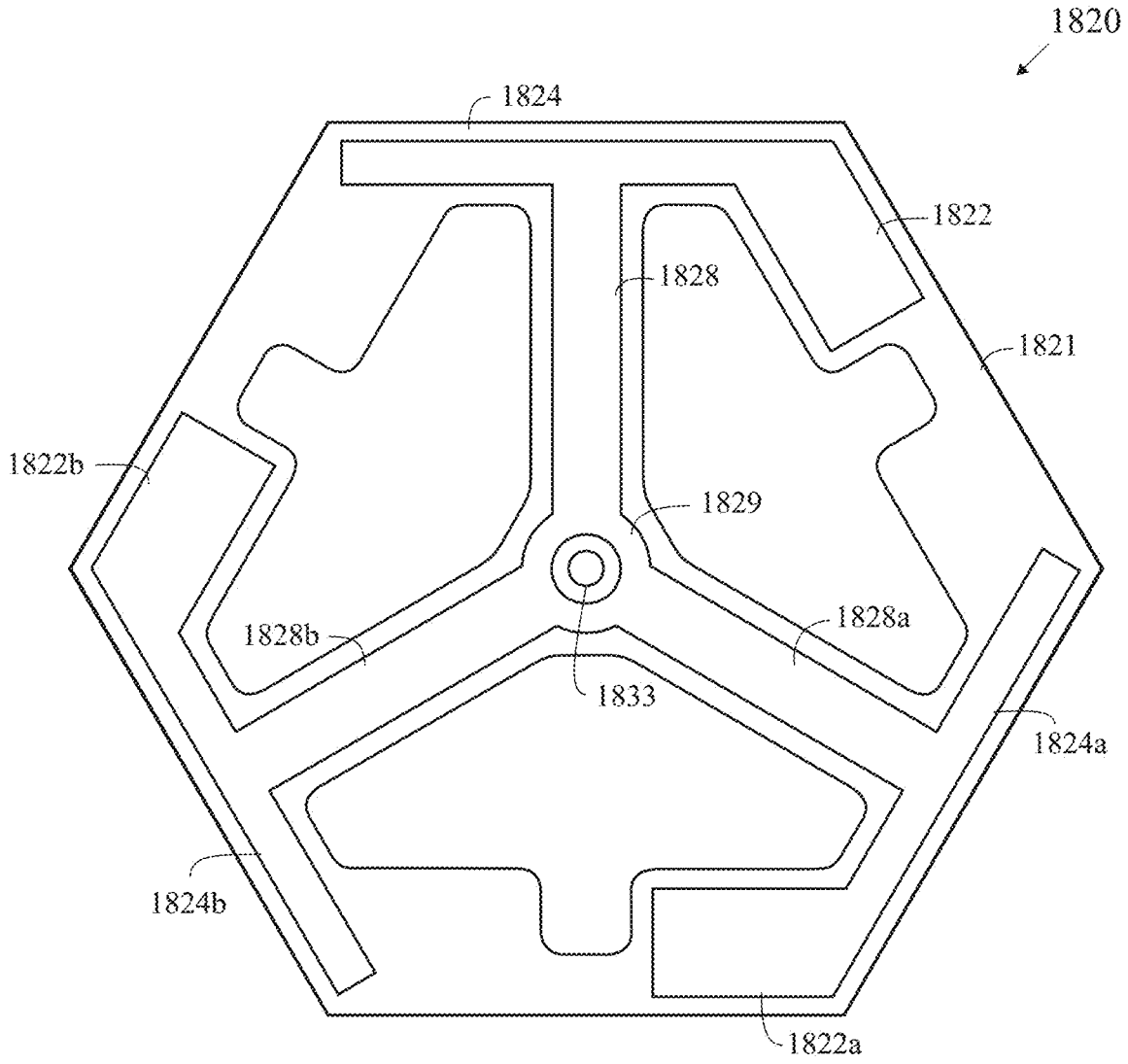
FIG. 18 is a top plan view of an alternative embodiment of a dual band horizontally polarized omnidirectional antenna.

As shown in FIG. 18, an alternative embodiment of a dual band horizontally polarized omnidirectional antenna 1820 comprises a dielectric 1821, a top low band dipole arm 1822, 1822*a*, and 1822*b*, a capacitive extension 1824, 1824*a* and 1824*b* of the arm, a transmission line 1828, 1828*a* and 1828*b*, a feed pad 1829, a bottom side array, a bottom side ground pad, and a hole 1833 for feed.

Figure 19:
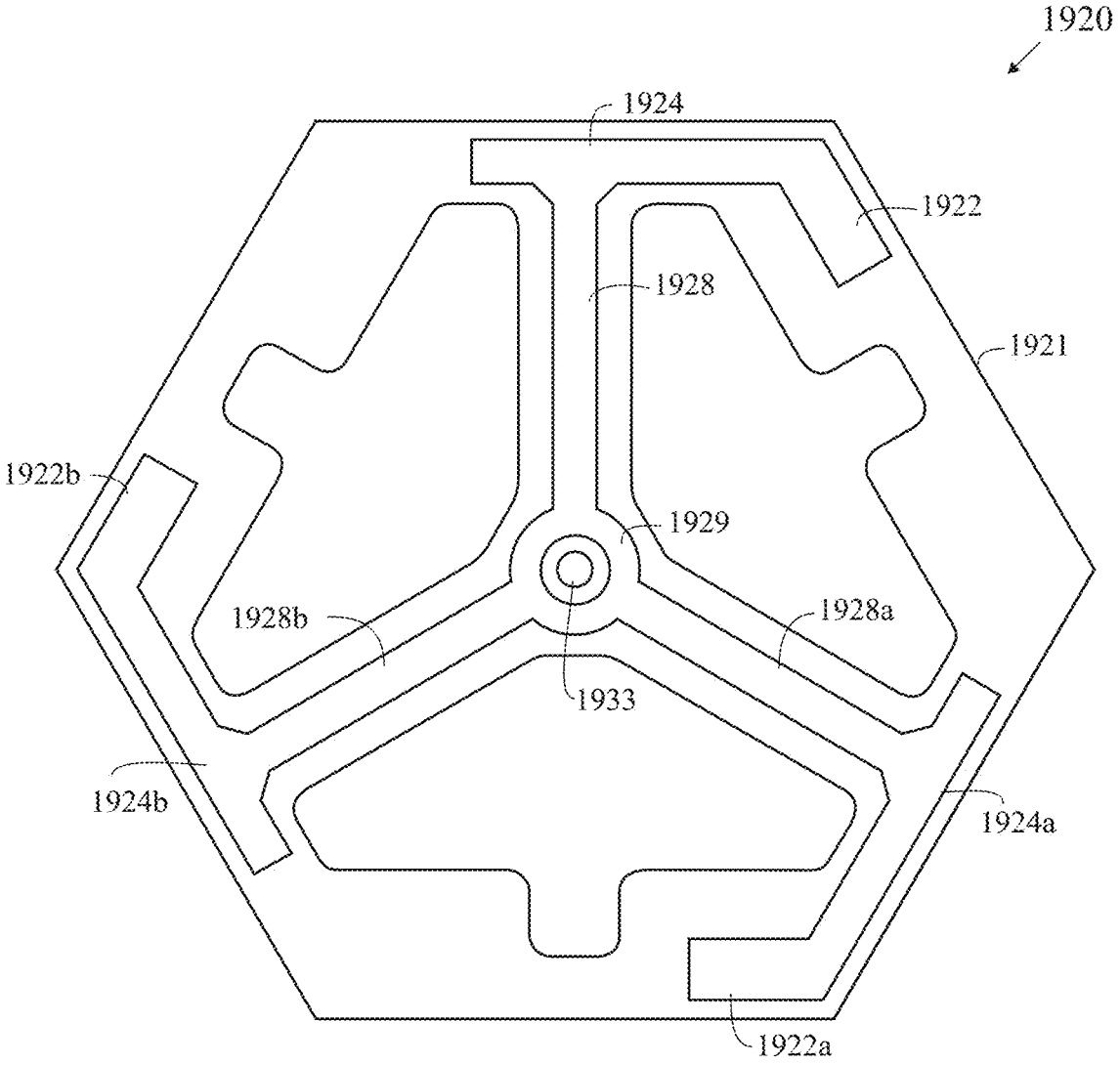
FIG. 19 is a top plan view of an alternative embodiment of a dual band horizontally polarized omnidirectional antenna.
Figure 20:
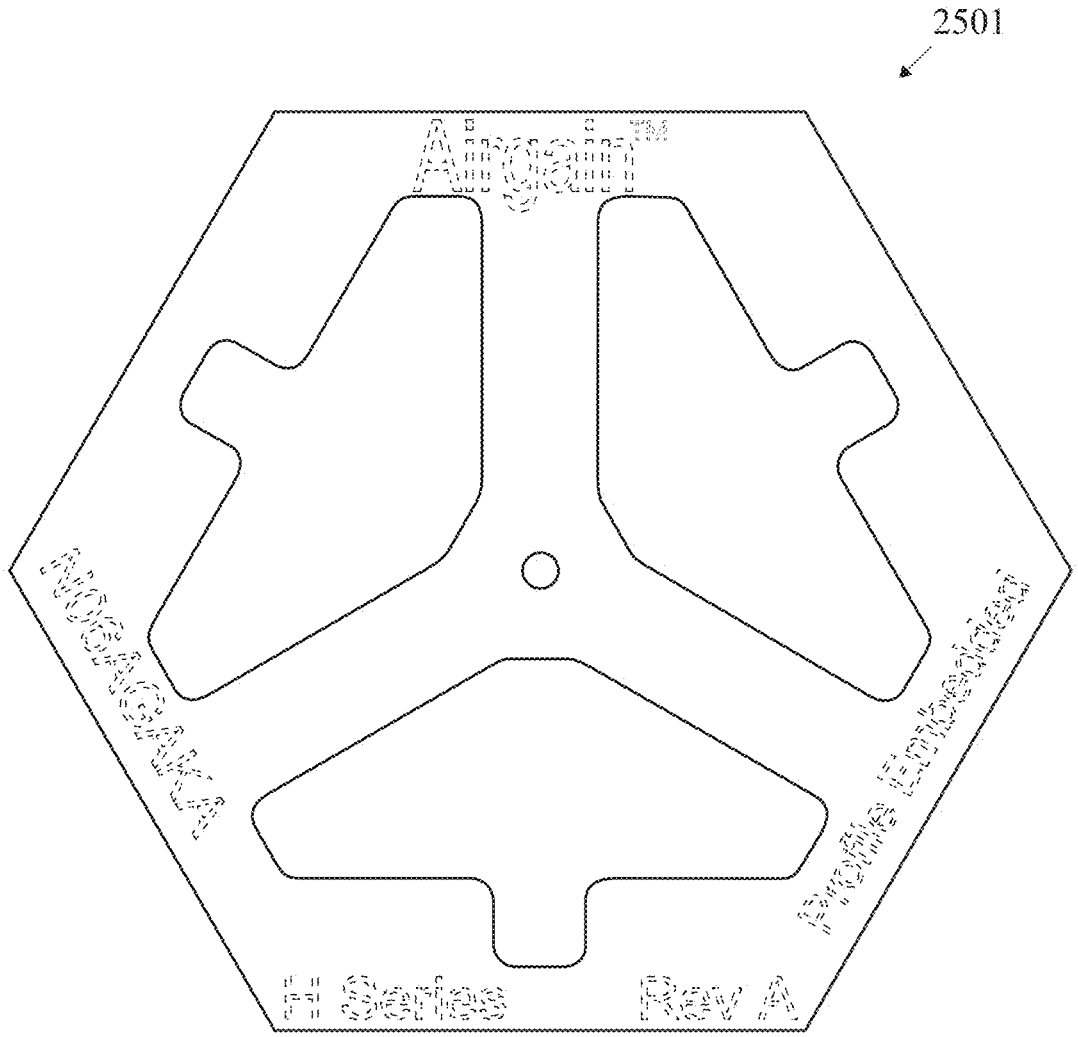
FIG. 20 is a top silk layer of an antenna assembly for a dual band horizontally polarized omnidirectional antenna.
Figure 21:
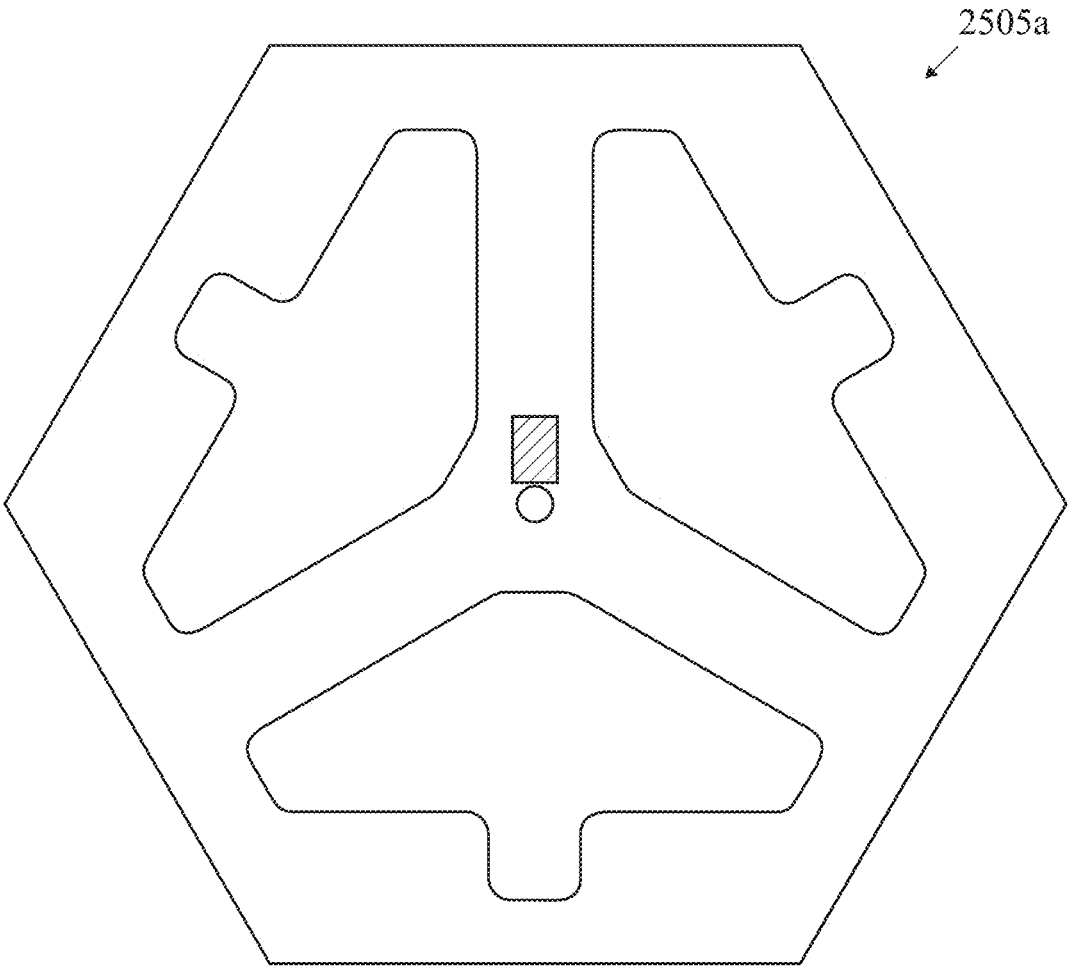
FIG. 21 is a top mask layer of an antenna assembly for a dual band horizontally polarized omnidirectional antenna.
Figure 22:
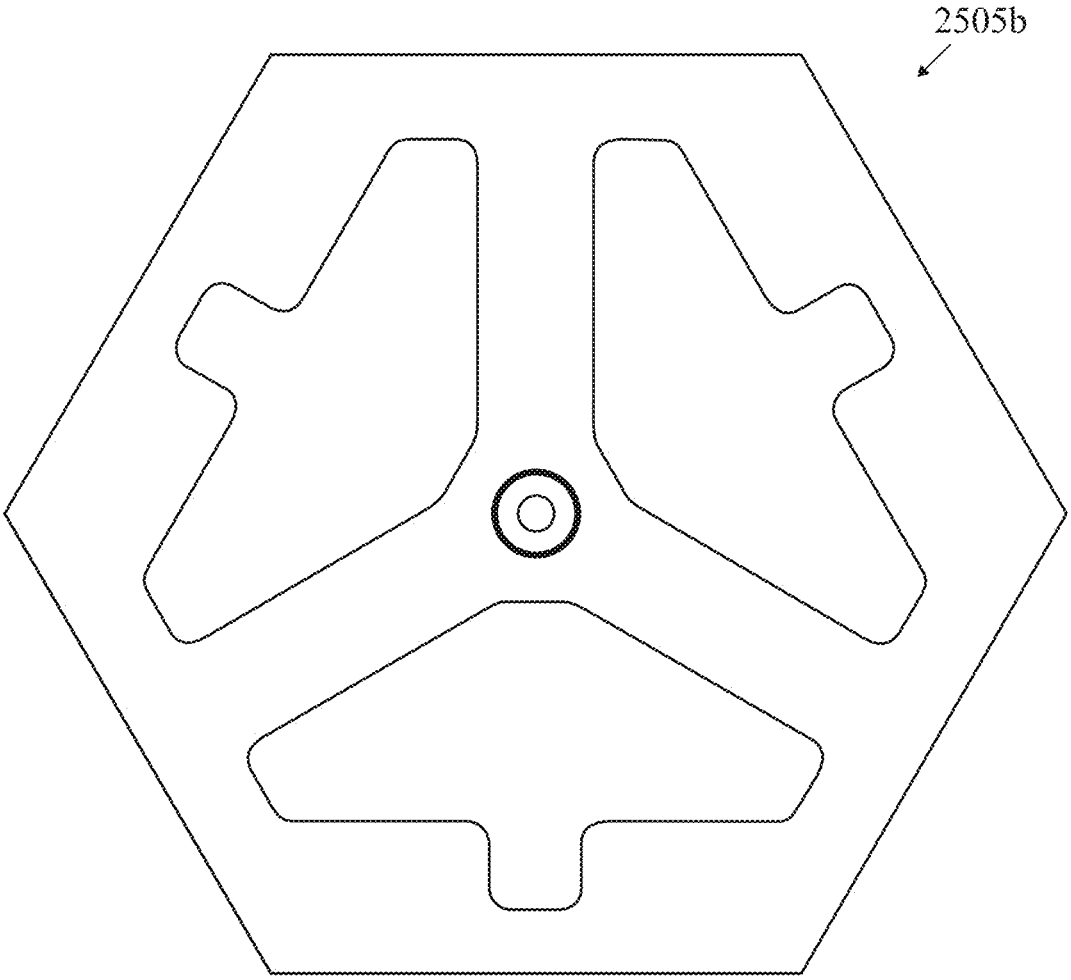
FIG. 22 is a bottom mask layer of an antenna assembly for a dual band horizontally polarized omnidirectional antenna.
Figure 23:
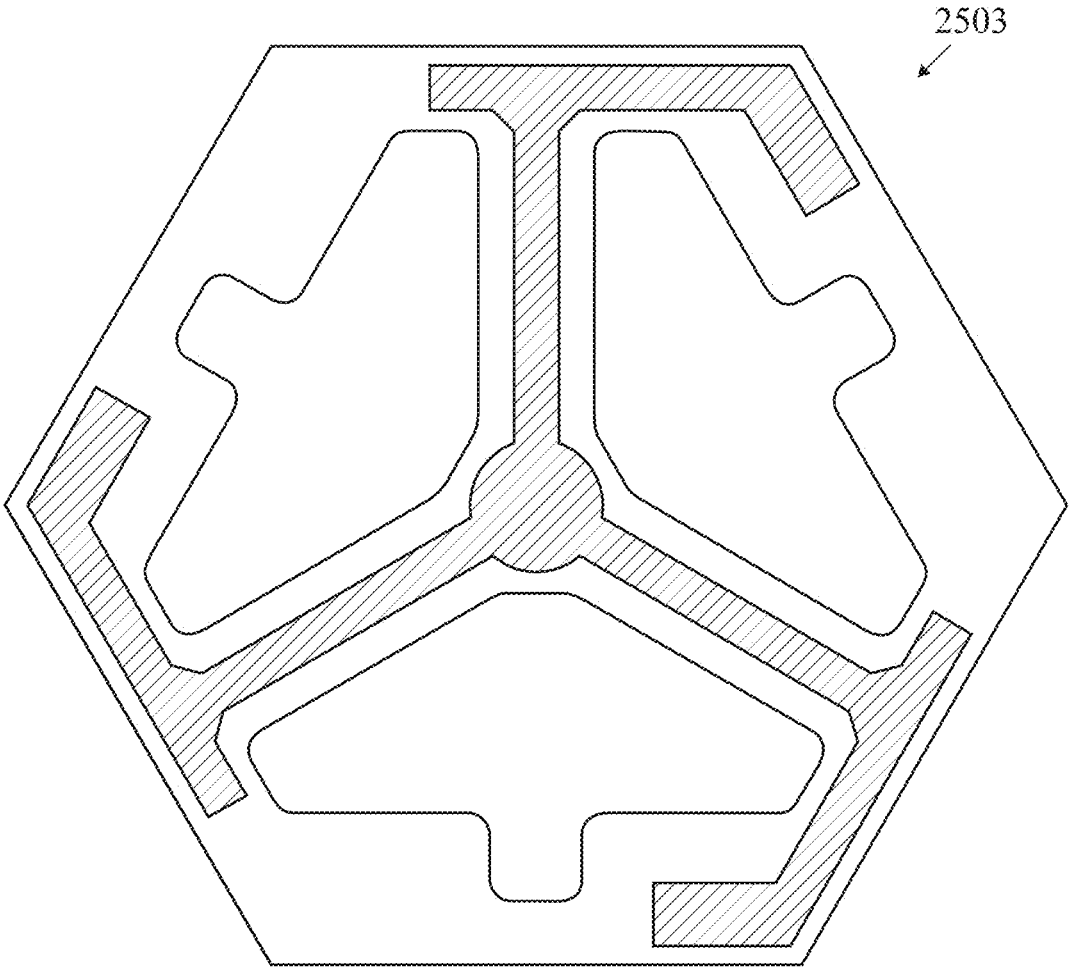
FIG. 23 is a bottom layer of an antenna assembly for a dual band horizontally polarized omnidirectional antenna.
Figure 24:
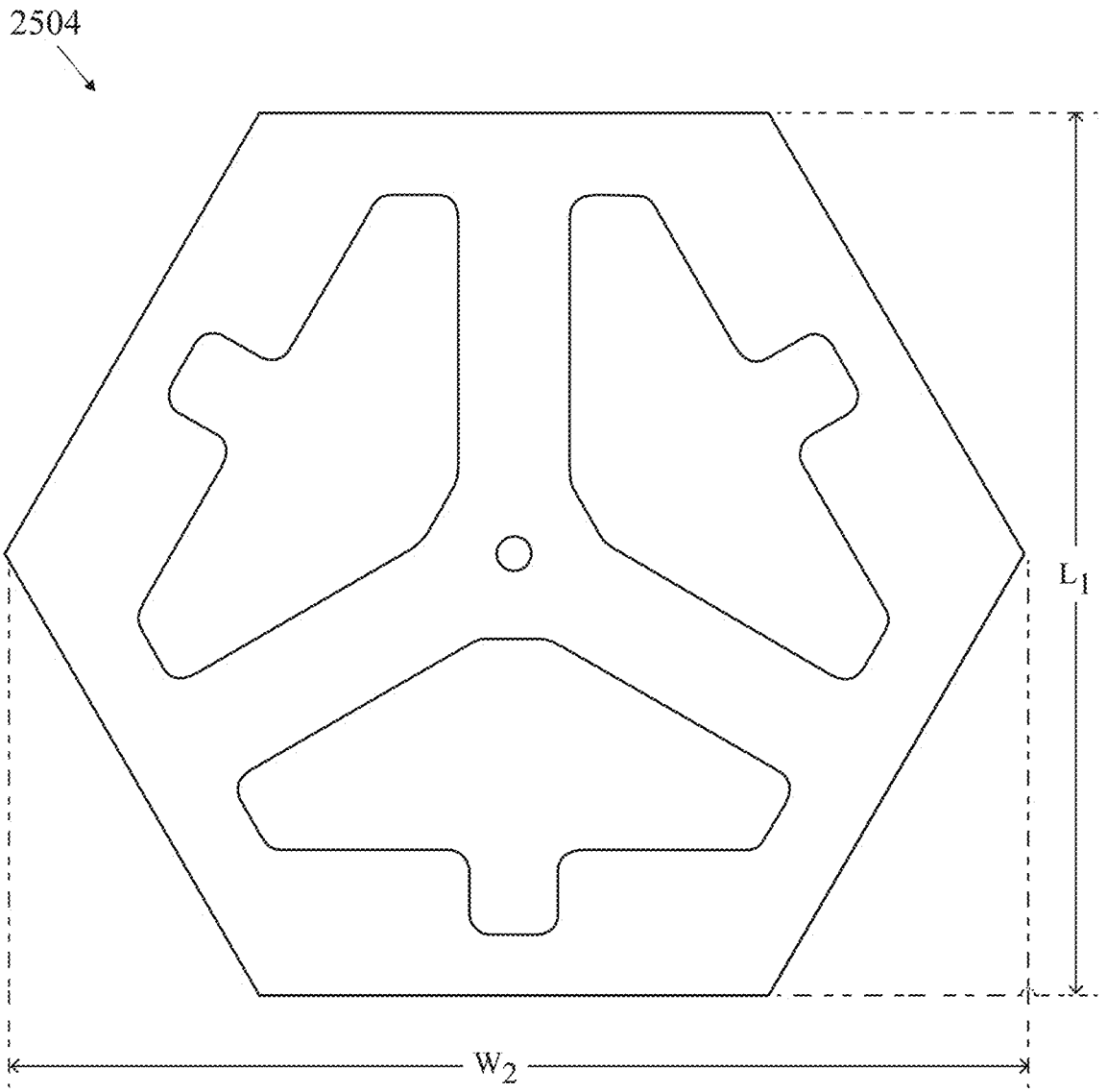
FIG. 24 is a drill drawing layer of an antenna assembly for a dual band horizontally polarized omnidirectional antenna.

As shown in FIG. 19, an alternative embodiment of a dual band horizontally polarized omnidirectional antenna 1920 comprises a dielectric 1921, a top low band dipole arm 1922, 1922*a*, and 1922*b*, a capacitive extension 1924, 1924*a* and 1924*b* of the arm, a transmission line 1928, 1928*a* and 1928*b*, a feed pad 1929, a bottom side array, a bottom side ground pad, and a hole 1933 for feed. FIG. 20 is a top silk layer 2501 of the antenna assembly for a dual band horizontally polarized omnidirectional antenna shown in FIG. 19. FIG. 21 is a top mask layer 2505*a* of an antenna assembly for a dual band horizontally polarized omnidirectional antenna. FIG. 22 is a bottom mask layer 2505*b* of the antenna assembly for a dual band horizontally polarized omnidirectional antenna shown in FIG. 19. FIG. 23 is a bottom layer 2503 of the antenna assembly for a dual band horizontally polarized omnidirectional antenna shown in FIG. 19. FIG. 24 is a drill drawing layer 2504 of the antenna assembly for a dual band horizontally polarized omnidirectional antenna shown in FIG. 19, and the structure has a length, L1, preferably ranging from 15-25 millimeters (mm), more preferably ranging from 18-22 mm, and most preferably ranging from 19-21 mm. The structure has a width, W1, ranging from 20-30 mm, more preferably ranging from 22-28 mm, and most preferably ranging from 23-25 mm.

Figure 25:
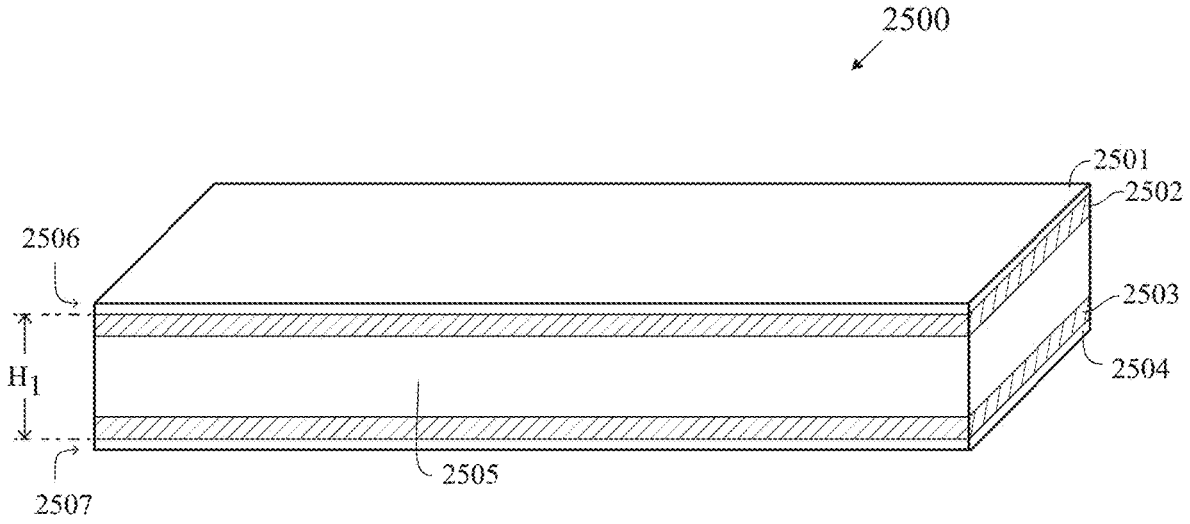
FIG. 25 is a layer stackup of an antenna assembly for a dual band horizontally polarized omnidirectional antenna.

FIG. 25 is a layer stackup 2500 of an antenna assembly for the dual band horizontally polarized omnidirectional antenna shown in FIG. 19. The stackup comprises a top solder mask layer 2501, a bottom solder mask layer 2502, a top copper layer 2503, a bottom copper layer 2504, a core layer 2505, a top layer 2506 and a bottom layer 2507.

As shown in FIGS. 1-3, 13 and 14, the dielectric 21 is a structure of the array. The top low band dipole arm 22, 22*a* and 22*b* is the feed side of the low band dipoles. The narrow section 23,23*a* and 23*b* of the arm reduces operating frequency. The capacitive extension 24, 24*a* and 24*b* of the arm adjusts the impedance so both the low band and the high band can be optimized simultaneously. The top high band dipole arm 25, 25*a* and 25*b* feeds a side of the high band dipole. The first section 27, 27*a* and 27*b* of a transmission line connects the high band elements of the array to the center feed point. The second section 28.28*a* and 28*b* of the transmission line, along with first section, connects the low band elements of the array to the center feed point. The feed pad 29 is a coax feed connection point and connection of array transmission lines. The coax center pin solder point 30 allows for a solder connection. The bottom side array 31 is all of the elements of the top side array but in a mirror image, and thus forms the ground or counterpoise side of the dipoles and complimentary side of the transmission lines. The bottom side ground pad 32 is the coax shield and solder is attached to this pad. The hole 33 for the feed is the center conductor of the coax and passes through this hole to connect to the top side feed pad 29.

An input is one RF connection which carriers signals between antenna and radio, and outputs an RF signal, in particular WiFi signaling per 802.11 standards. Another input is radio waves to and from the antenna of the present invention and other antennas of other devices.

A preferred dimension ranges from 43 millimeters (mm) to 51 mm, and most preferably 47 mm across the hexagonal dielectric 1. The dielectric constant is preferably 4.2.

Antennas are selected from the group of antennas consisting of a WiFi 2G antenna, a WiFi 5G antenna, a DECT antenna, a ZigBee antenna and a Zwave antenna. The WiFi 2G antennas are preferably 2400-2690 MegaHertz. The WiFi 5G antenna is preferably a 5.8 GigaHertz antenna. Alternatively, the antenna element operates at 5.15 GHz or at 5.85 GHz. Other possible frequencies for the second antenna element 43 include 5150 MHz, 5200 MHz, 5300 MHz, 5400 MHz, 5500 MHz, 5600 MHz, 5700 MHz, 5850 MHz, and 2.4 GHz. The antenna element preferably operates on an 802.11 communication protocol. Most preferably, the antenna element operates on an 802.11n communication protocol. Alternatively, the antenna element operates on an 802.11b communication protocol. Alternatively, the antenna element operates on an 802.11g communication protocol. Alternatively, the antenna element operates on an 802.11a communication protocol. Alternatively, the antenna element operates on an 802.11 ac communication protocol.

Thill, U.S. Pat. No. 10,109,918 for a Multi-Element Antenna For Multiple bands Of Operation And Method Therefor, is hereby incorporated by reference in tis entirety.

He, U.S. Pat. No. 9,362,621 for a Multi-Band LTE Antenna is hereby incorporated by reference in its entirety.

Abramov et al., U.S. Pat. No. 7,215,296 for a Switch Multi-Beam Antenna Serial is hereby incorporated by reference in its entirety.

Salo et al., U.S. Pat. No. 7,907,971 for an Optimized Directional Antenna System is hereby incorporated by reference in its entirety.

Abramov et al., U.S. Pat. No. 7,570,215 for an Antenna device with a controlled directional pattern and a planar directional antenna is hereby incorporated by reference in its entirety.

Abramov et al., U.S. Pat. No. 7,570,215 for an Antenna device with a controlled directional pattern and a planar directional antenna is hereby incorporated by reference in its entirety.

Abramov et al., U.S. Pat. No. 8,423,084 for a Method for radio communication in a wireless local area network and transceiving device is hereby incorporated by reference in its entirety.

Khitrik et al., U.S. Pat. No. 7,336,959 for an Information transmission method for a wireless local network is hereby incorporated by reference in its entirety.

Khitrik et al., U.S. Pat. No. 7,043,252 for an Information transmission method for a wireless local network is hereby incorporated by reference in its entirety.

Abramov et al., U.S. Pat. No. 8,184,601 for a METHOD FOR RADIO COMMUNICATION INA WIRELESS LOCAL AREA NETWORK WIRELESS LOCAL AREA NETWORK AND TRANSCEIVING DEVICE is hereby incorporated by reference in its entirety.

Abramov et al., U.S. Pat. No. 7,627,300 for a Dynamically optimized smart antenna system is hereby incorporated by reference in its entirety.

Abramov et al., U.S. Pat. No. 6,486,832 for a Direction-agile antenna system for wireless communications is hereby incorporated by reference in its entirety.

Yang, U.S. Pat. No. 8,081,123 for a COMPACT MULTI-LEVEL ANTENNA WITH PHASE SHIFT is hereby incorporated by reference in its entirety.

Nagaev et al., U.S. Pat. No. 7,292,201 for a Directional antenna system with multi-use elements is hereby incorporated by reference in its entirety.

Abramov et al., U.S. Pat. No. 7,696,948 for a Configurable directional antenna is hereby incorporated by reference in its entirety.

Abramov et al., U.S. Pat. No. 7,965,242 for a Dual-band antenna is hereby incorporated by reference in its entirety.

Abramov et al., U.S. Pat. No. 7,729,662 for a Radio communication method in a wireless local network is hereby incorporated by reference in its entirety.

Abramov et al., U.S. Pat. No. 8,248,970 for an OPTIMIZED DIRECTIONAL MIMO ANTENNA SYSTEM is hereby incorporated by reference in its entirety.

Visuri et al., U.S. Pat. No. 8,175,036 for a MULTIMEDIA WIRELESS DISTRIBUTION SYSTEMS AND METHODS is hereby incorporated by reference in its entirety.

Yang, U.S. Patent Publication Number 20110235755 for an MIMO Radio System With Antenna Signal Combiner is hereby incorporated by reference in its entirety.

Yang et al., U.S. Pat. No. 9,013,355 for an L SHAPED FEED AS PART OF A MATCHING NETWORK FOR A MICROSTRIP ANTENNA is hereby incorporated by reference in its entirety.

Iellici, U.S. Pat. No. 10,305,182 for a Balanced Antenna is hereby incorporated by reference in its entirety.

He et al., U.S. Pat. No. 10,164,324 for Antenna Placement Topologies For Wireless Network System Throughputs Improvement is hereby incorporated by reference in its entirety.

Yang, U.S. Pat. No. 9,912,043 for an Antenna System For A Large Appliance is hereby incorporated by reference in its entirety.

Thill et al., U.S. Pat. No. 8,669,903 for a Dual Frequency Band Communication Antenna Assembly Having An Inverted F Radiating Element is hereby incorporated by reference in its entirety.

Thill et al., U.S. Pat. No. 6,850,191 for a Dual Frequency Band Communication Antenna is hereby incorporated by reference in its entirety.

Thill et al., U.S. Pat. No. 6,087,990 for a Dual Function Communication Antenna is hereby incorporated by reference in its entirety.

Thill, U.S. Pat. No. 10,511,086 for an Antenna Assembly For A Vehicle is hereby incorporated by reference in its entirety.

He et al., U.S. patent application Ser. No. 16/379,767, filed on Apr. 9, 2019, for a 5G Broadband Antenna is hereby incorporated by reference in its entirety.

Figure 4:
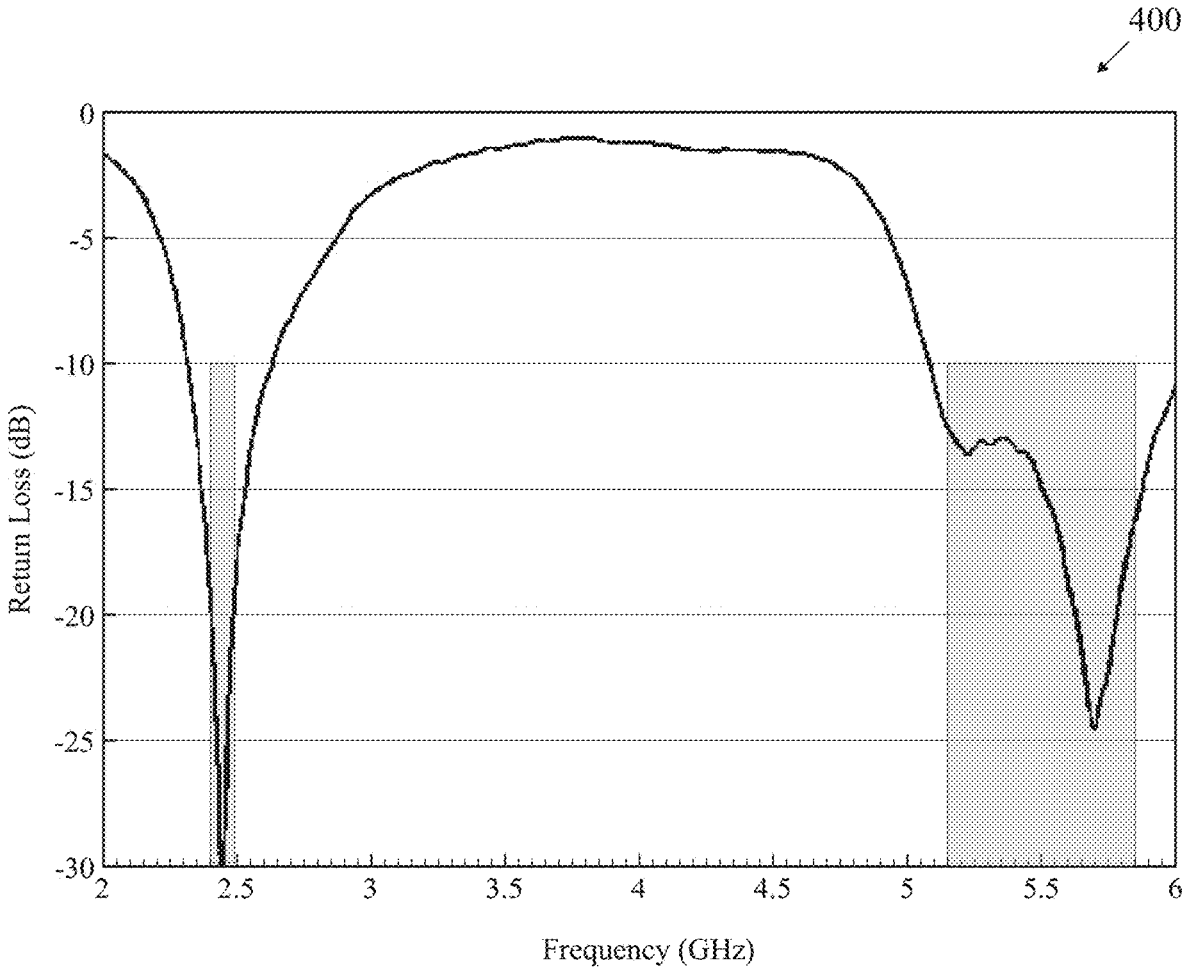
FIG. 4 is a graph of S-parameter—return loss for a dual band horizontally polarized omnidirectional antenna wherein 2.4 Ghz has a return loss of −19.3 dB, wherein 2.49 GHz has a return loss of −19.2 dB, wherein 5.15 GHz has a return loss of −12.5 dB, and wherein 16.2 GHz has a return loss of −16.2 dB.

FIG. 4 is a graph 400 of S-parameter—return loss for a dual band horizontally polarized omnidirectional antenna wherein 2.4 Ghz has a return loss of −19.3 dB, wherein 2.49 GHz has a return loss of −19.2 dB, wherein 5.15 GHz has a return loss of −12.5 dB, and wherein 16.2 GHz has a return loss of −16.2 dB.

Figure 5:
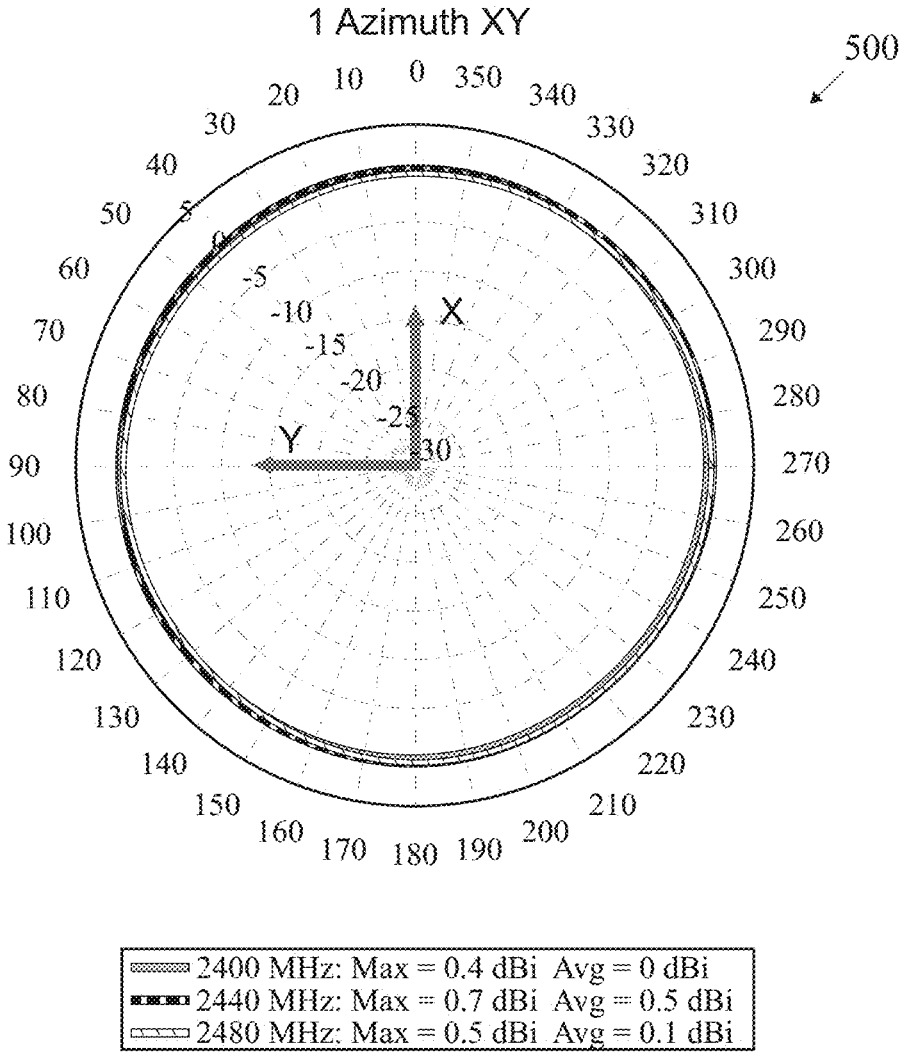
FIG. 5 is a graph of Azimuth XY for a total gain for a 2G Band.

FIG. 5 is a graph 500 of Azimuth XY for a total gain for a 2G Band.

Figure 6:
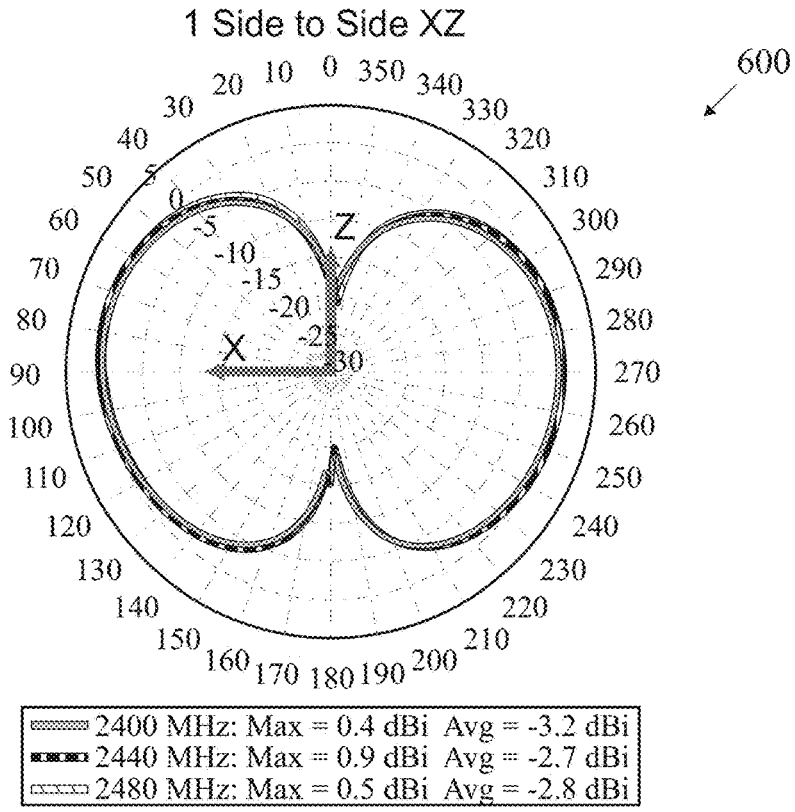
FIG. 6 is a graph of side to side XZ for a total gain for a 2G Band.

FIG. 6 is a graph 600 of side to side XZ for a total gain for a 2G Band.

Figure 7:
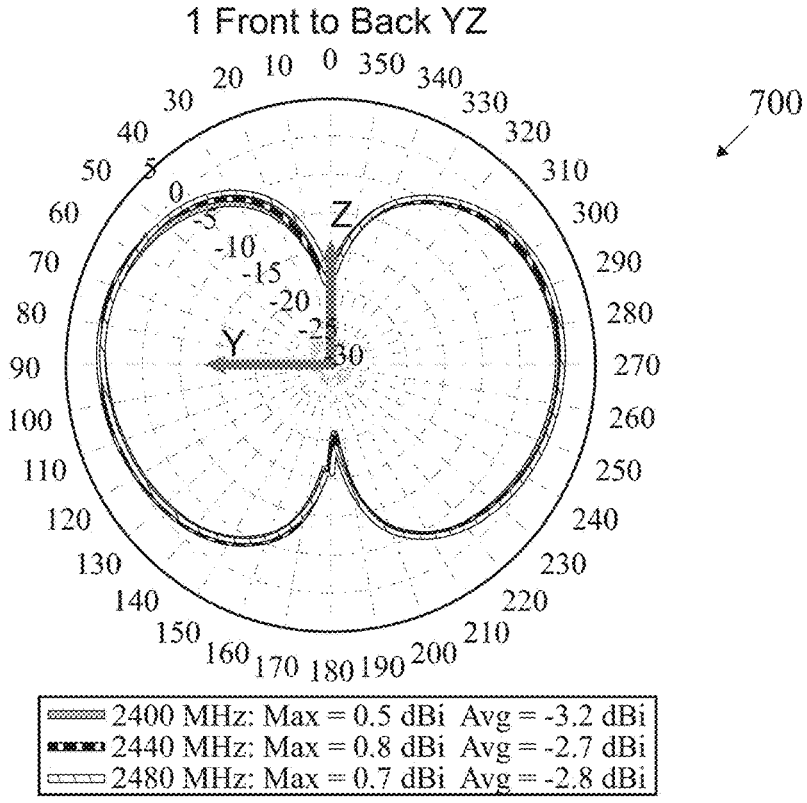
FIG. 7 is a graph of front to back YZ for a total gain for a 2G Band.

FIG. 7 is a graph 700 of front to back YZ for a total gain for a 2G Band.

FIG. 8 is a graph 800 of azimuth gain by polarization (dBi) for a 2G band.

FIG. 9 is a graph 900 of Azimuth XY for a total gain 5G Band.

FIG. 10 is a graph 1000 of side to side XZ for a total gain 5G Band.

FIG. 11 is a graph 1100 of front to back YZ for a total gain 5G Band.

FIG. 12 is a graph 1200 of azimuth gain by polarization (dBi) for a 5G band Table One and Two show antenna efficiency with a 50 mm cable, with an average of 78% for table one and 68% for Table Two. Tables Three and Four show Peak Gain (dBi).

TABLE ONE

| Frequency (MHz) | Ant 1 |
|---|---|
| 2400 | 72% |
| 2410 | 74% |
| 2420 | 77% |
| 2430 | 80% |
| 2440 | 81% |
| 2450 | 80% |
| 2460 | 80% |
| 2470 | 80% |
| 2480 | 78% |
| 2490 | 76% |
| Average | 78% |

TABLE TWO

| Frequency (MHz) | Ant 1 |
|---|---|
| 5150 | 61% |
| 5200 | 66% |
| 5300 | 71% |
| 5400 | 70% |
| 5500 | 67% |
| 5600 | 68% |
| 5700 | 71% |
| 5800 | 70% |
| 5850 | 69% |

TABLE THREE

| Frequency (MHz) | Ant 1 |
|---|---|
| 2400 | 0.5 |
| 2410 | 0.5 |
| 2420 | 0.7 |
| 2430 | 0.8 |
| 2440 | 0.9 |
| 2450 | 0.8 |
| 2460 | 0.8 |
| 2470 | 0.8 |
| 2480 | 0.7 |
| 2490 | 0.6 |

TABLE FOUR

| Frequency (MHz) | Ant 1 |
|---|---|
| 5150 | 1.8 |
| 5200 | 2.2 |
| 5300 | 2.3 |
| 5400 | 2.2 |
| 5500 | 1.9 |
| 5600 | 2.0 |
| 5700 | 2.3 |
| 5800 | 2.2 |
| 5850 | 2.2 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim as my invention the following:

1. A dual band horizontally polarized omnidirectional antenna comprising:

a dielectric;

a feed pad;

a coax center pin solder point;

a bottom side ground pad;

a hole for feed; and an array of dipoles each comprising a feed side low band dipole arm, a narrow section of the feed side low band dipole arm, a capacitive extension of the feed side low band dipole arm, a feed side high band dipole arm, a narrow section of the high band dipole arm, a ground side low band dipole arm, a narrow section of the ground side low band dipole arm, a capacitive extension of the ground side low band dipole arm, a ground side high band dipole arm, a narrow section of the ground side high band dipole arm, a first section of a transmission line, and a second section of the transmission line.

2. The antenna according to claim 1 wherein the top low band dipole arm is the feed side of the low band dipoles.

3. The antenna according to claim 1 wherein the narrow section of the feed side low band dipole arm reduces operating frequency.

4. The antenna according to claim 1 wherein the capacitive extension of the dipole arms adjusts the impedance so both the low band and the high band can be optimized simultaneously.

5. The antenna according to claim 1 wherein the top high band dipole arms feeds a side of the high band dipole.

6. The antenna according to claim 1 wherein the first section of a transmission line connects the high band elements of the array to the center feed point.

7. The antenna according to claim 1 wherein the second section of the transmission line, along with first section, connects the low band elements of the array to the center feed point.

8. The antenna according to claim 1 wherein the feed pad is a coax feed connection point and connection of array transmission lines.

9. The antenna according to claim 1 wherein the bottom side array is all of the elements of the top side array but in a mirror image, and thus forms the ground or counterpoise side of the dipoles and complimentary side of the transmission lines.

10. The antenna according to claim 1 wherein the low band ranges from 2.4 to 2.49 GigaHertz (GHz) and the high band ranges from 5.15 to 5.85 GHz.

11. A dual band horizontally polarized omnidirectional antenna comprising:

a dielectric structure array;

a feed pad on the dielectric structure array;

a plurality of dipoles on the dielectric structure array, each of the plurality of dipoles comprising a transmission line extending from the feed pad at one end;

a top low band dipole arm contacted the transmission at an opposite end of the transmission line, a narrow section of the top low band dipole arm, a capacitive extension of the top low band dipole arm, a top high band dipole arm extending from the transmission line between the feed pad and the top low band dipole arm, and a narrow section of the high band dipole arm.

12. The antenna according to claim 11 wherein a low band ranges from 2.4 to 2.49 GigaHertz (GHz) and a high band ranges from 5.15 to 5.85 GHz.

13. A dual band horizontally polarized omnidirectional antenna comprising:

a dielectric structure array;

a feed pad;

a first member comprising a transmission line extending from the feed pad, a top high band dipole, a capacitive extension, a top low band dipole arm and a narrow section between the capacitive extension and the top low band dipole arm;

a second member comprising a transmission line extending from the feed pad, a top high band dipole, a capacitive extension, a top low band dipole arm and a narrow section between the capacitive extension and the top low band dipole arm; and a third member comprising a transmission line extending from the feed pad, a top high band dipole, a capacitive extension, a top low band dipole arm and a narrow section between the capacitive extension and the top low band dipole arm.

14. The antenna according to claim 13 wherein the first member, the second member and the third member are symmetrically arranged about a center point.

15. The antenna according to claim 13 further comprising an inductive connection between the feed pad and a ground side of each of the first member, the second member and the third member.

16. The antenna according to claim 13 wherein the low band ranges from 2.4 to 2.49 GigaHertz (GHz) and the high band ranges from 5.15 to 5.85 GHz.

* * * * *